US008725036B2

(12) United States Patent
Yamashita et al.

(10) Patent No.: US 8,725,036 B2
(45) Date of Patent: May 13, 2014

(54) ELECTROPHOTOGRAPHIC PHOTORECEPTOR, PROCESS CARTRIDGE AND IMAGE FORMING APPARATUS

(75) Inventors: Takayuki Yamashita, Kanagawa (JP); Isamu Ishiko, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 420 days.

(21) Appl. No.: 13/086,886

(22) Filed: Apr. 14, 2011

(65) Prior Publication Data

US 2012/0114379 A1 May 10, 2012

(30) Foreign Application Priority Data

Nov. 10, 2010 (JP) ..... 2010-251800

(51) Int. Cl.
*G03G 15/00* (2006.01)

(52) U.S. Cl.
USPC ..... 399/117; 399/159; 430/66; 430/69

(58) Field of Classification Search
USPC ..... 399/117, 159; 430/69
See application file for complete search history.

(56) References Cited

U.S. PATENT DOCUMENTS 4,654,284 A * 3/1987 Yu et al. ..... 430/58.65
5,630,196 A * 5/1997 Swain ..... 399/117
5,652,077 A * 7/1997 Obinata ..... 430/56
5,675,893 A 10/1997 Yamada et al.
5,774,767 A * 6/1998 Shibata et al. ..... 399/167
5,815,773 A * 9/1998 Zaman ..... 399/117
5,907,750 A 5/1999 Yamada et al.
5,968,622 A * 10/1999 Kawata et al. ..... 428/36.9
6,002,897 A * 12/1999 Kohno et al. ..... 399/117
6,104,896 A * 8/2000 Zaman et al. ..... 399/117
6,157,038 A * 12/2000 Swain et al. ..... 250/459.1
6,381,429 B1 * 4/2002 Shibata et al. ..... 399/117
6,490,426 B1 * 12/2002 Zaman ..... 399/117
6,800,411 B2 * 10/2004 Tong et al. ..... 430/58.05

(Continued)

FOREIGN PATENT DOCUMENTS

JP A-5-99737 4/1993
JP A-6-264920 9/1994
JP 11338310 A * 12/1999
JP 2001331061 A * 11/2001

OTHER PUBLICATIONS

English machine translation of Kawakami et al. (JP11-338310A); by Kawakami, Tetsuya; and Tanaka, Nobuhide; "Photoreceptor"; published Dec. 10, 1999.*

(Continued)

*Primary Examiner* — David Gray
*Assistant Examiner* — Geoffrey Evans
(74) *Attorney, Agent, or Firm* — Oliff PLC

(57) ABSTRACT

An electrophotographic photoreceptor includes: an electrophotographic photoreceptor body containing a cylindrical electroconductive substrate having openings at both ends in an axial direction, the cylindrical electroconductive substrate having a thickness of approximately 2 mm or more at a center portion in an axial direction and having a socket joint portion on each of inner surfaces of both end portions in an axial direction; and a photosensitive layer provided on an outer surface of the electroconductive substrate; and a support member fit in the openings of the electroconductive substrate, having an fitting portion which has an outer diameter that is larger than a diameter of the opening by a range of from approximately 0.01 mm to approximately 0.1 mm, the fitting portion being press-fit into the opening.

15 Claims, 9 Drawing Sheets

(56) References Cited

U.S. PATENT DOCUMENTS

| | | | | |
|---|---|---|---|---|
| 6,824,940 | B2 * | 11/2004 | Wu et al. | 430/66 |
| 7,642,028 | B2 * | 1/2010 | Wu et al. | 430/58.2 |
| 2002/0114906 | A1 * | 8/2002 | Iizuka et al. | 428/36.9 |
| 2006/0140648 | A1 * | 6/2006 | Takegawa | 399/12 |
| 2007/0087277 | A1 * | 4/2007 | Qi et al. | 430/58.55 |
| 2009/0180801 | A1 * | 7/2009 | Kuwabara et al. | 399/117 |
| 2009/0211475 | A1 * | 8/2009 | Taylor | 101/375 |
| 2011/0142492 | A1 * | 6/2011 | Tanaka et al. | 399/117 |
| 2011/0142493 | A1 * | 6/2011 | Tanaka et al. | 399/117 |
| 2013/0230338 | A1 * | 9/2013 | Kubo et al. | 399/159 |

OTHER PUBLICATIONS

English machine translation of Japanese patent document Shibata et al. (JP 2001-331061 A); published Nov. 30, 2001; by Shibata, Junichi; Yamada, Takashi; Sakamoto, Tetsuya; and Fukuda, Arimichi.*

* cited by examiner

ELECTROPHOTOGRAPHIC PHOTORECEPTOR, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2010-251800 filed Nov. 10, 2010.

BACKGROUND

1. Technical Field

The present invention relates to an electrophotographic photoreceptor, a process cartridge and an image forming apparatus.

2. Related Art

An image forming apparatus of an electrophotographic system generally has the following process. A surface of an electrophotographic photoreceptor is charged to a predetermined polarity with a charging unit, the charged surface of the electrophotographic photoreceptor is selectively erased by imagewise exposure to form an electrostatic latent image, a toner is attached to the electrostatic latent image with a developing unit to develop the latent image as a toner image, and the toner image is transferred to a recording medium with a transfer unit, thereby providing an image on the recording medium, which is delivered as a material having an image formed thereon.

SUMMARY

According to an aspect of the invention, there is provided an electrophotographic photoreceptor including:

an electrophotographic photoreceptor body containing a cylindrical electroconductive substrate having openings at both ends in an axial direction, the cylindrical electroconductive substrate having a thickness of approximately 2 mm or more at a center portion in an axial direction and having a socket joint portion on each of inner surfaces of both end portions in an axial direction; and a photosensitive layer provided on an outer surface of the electroconductive substrate; and a support member fit into the openings of the electroconductive substrate, having an fitting portion which has an outer diameter that is larger than a diameter of the opening by a range of from approximately 0.01 mm to approximately 0.1 mm, the fitting portion being press-fit into the opening.

BRIEF DESCRIPTION OF THE DRAWINGS

Exemplary embodiments of the present invention will be described in detail based on the following figures, wherein.

DETAILED DESCRIPTION

Exemplary embodiments of the invention will be described in detail below.

Electrophotographic Photoreceptor

Figure 1:
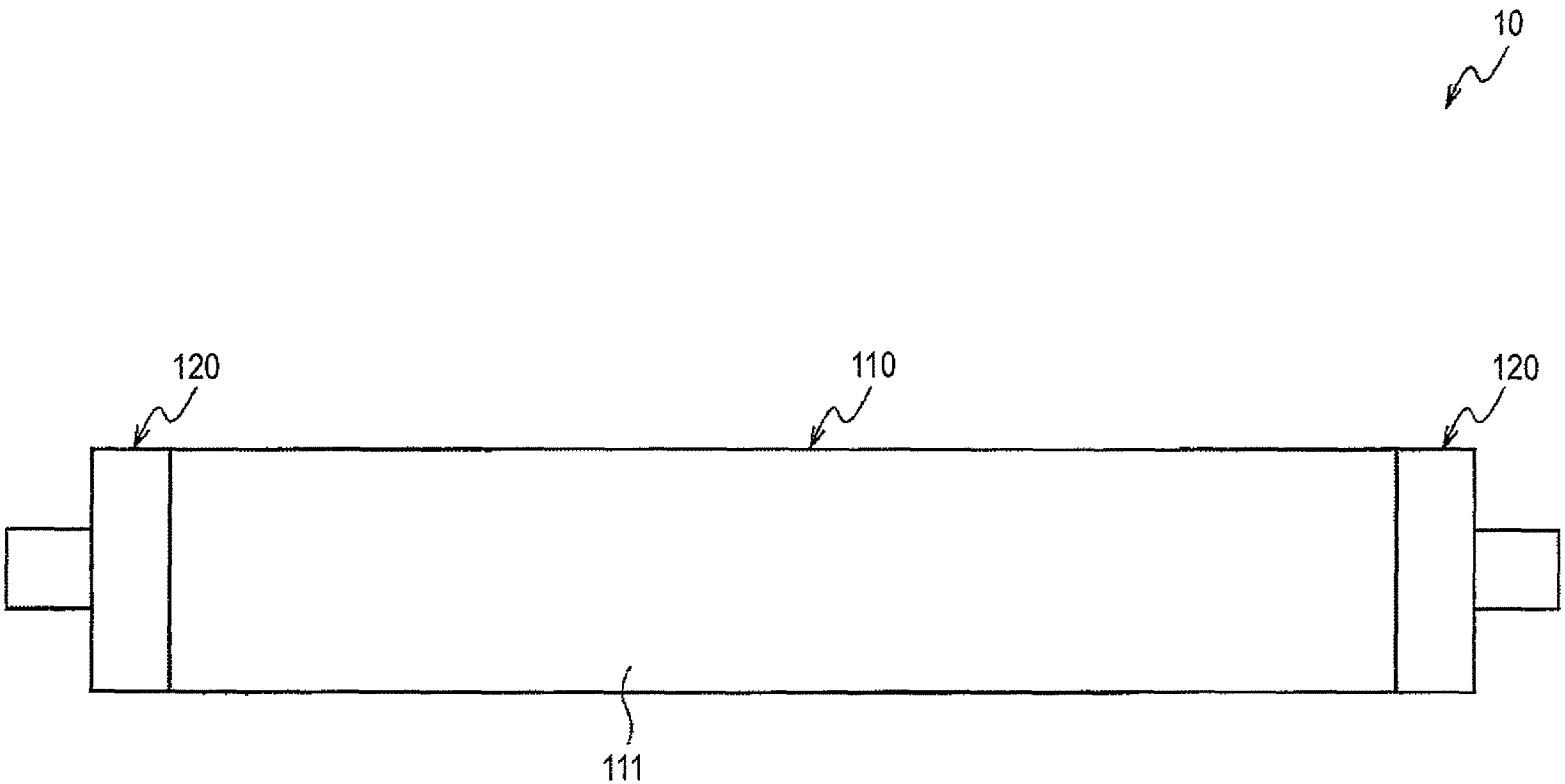
FIG. 1 is a schematic side view showing an example of an electrophotographic photoreceptor according to an exemplary embodiment.
Figure 2:
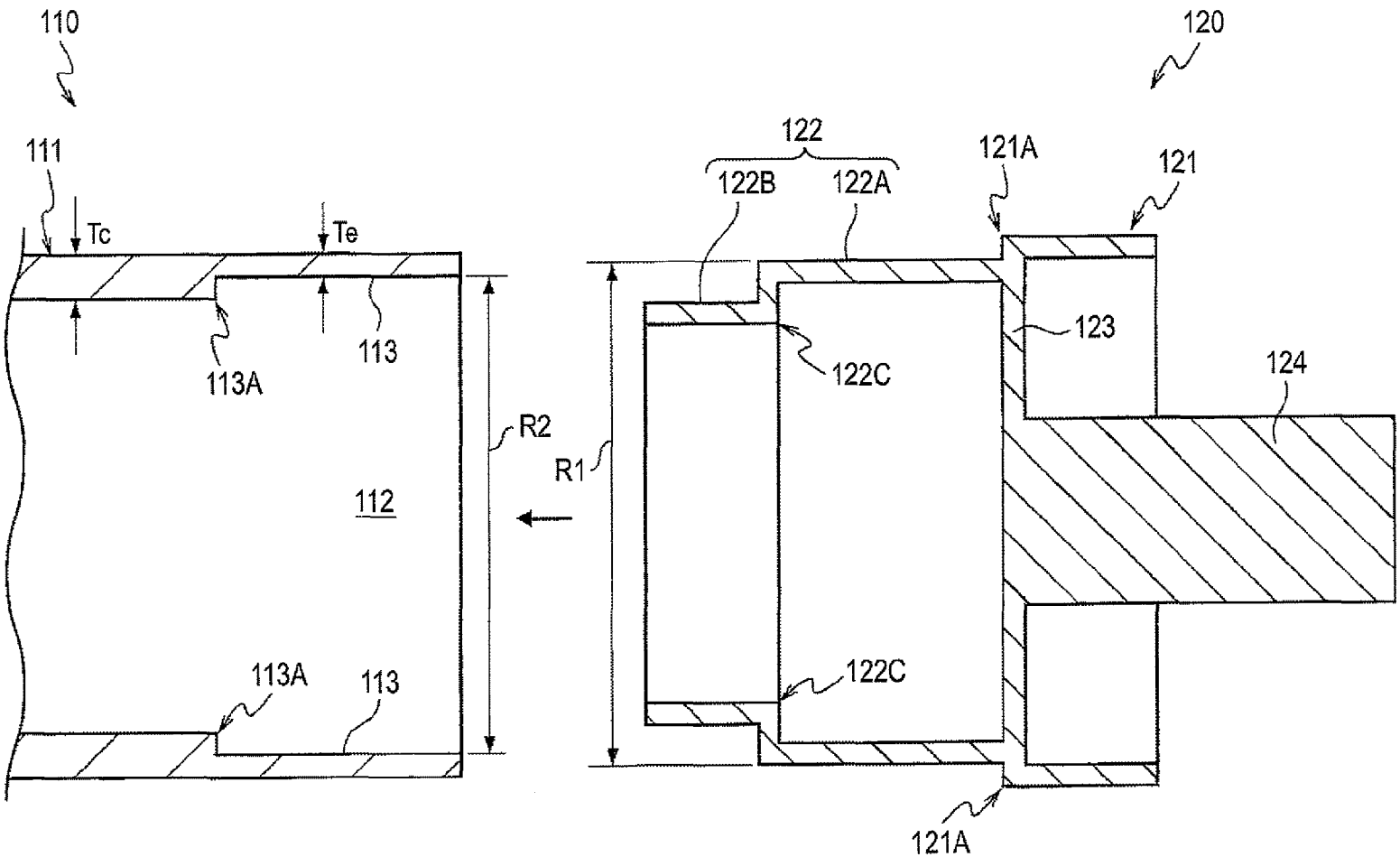
FIG. 2 is an exploded schematic cross sectional view showing an example of an electrophotographic photoreceptor according to an exemplary embodiment.
Figure 3:
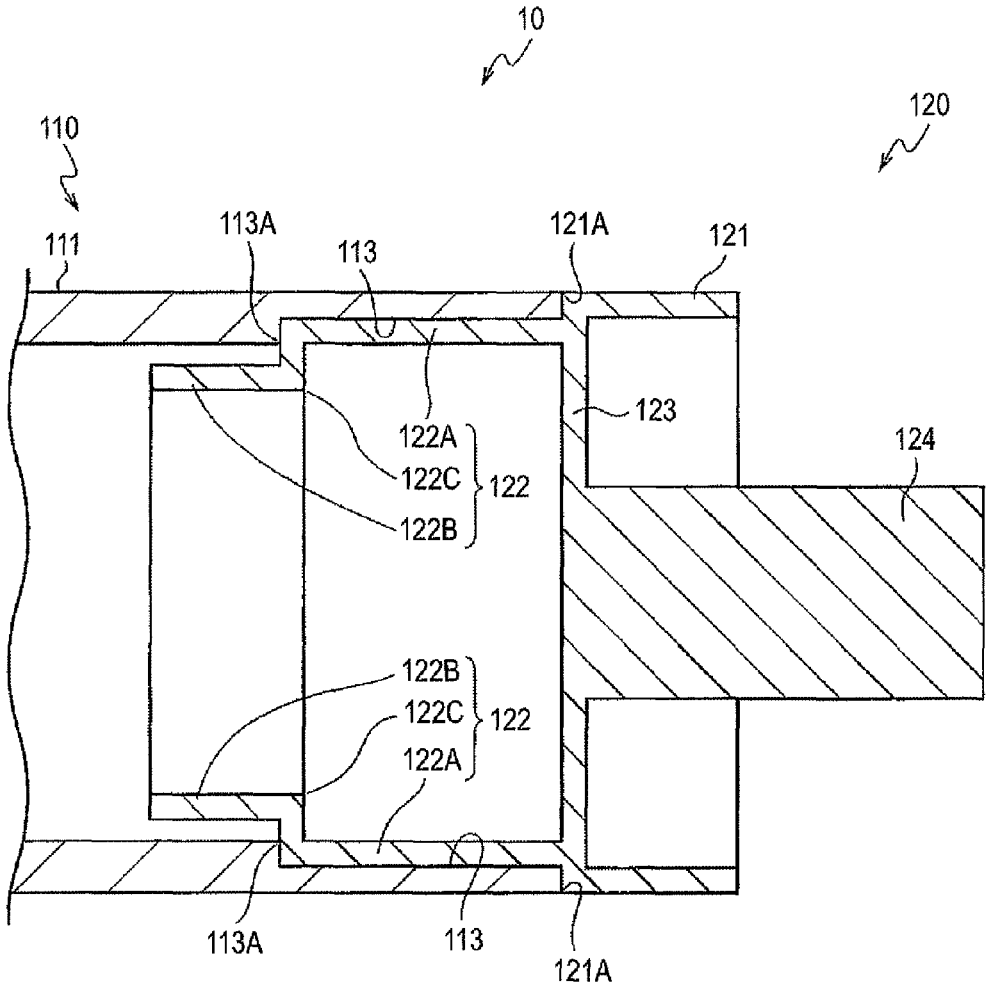
FIG. 3 is a partial schematic cross sectional view showing an example of an electrophotographic photoreceptor according to an exemplary embodiment.

FIG. 1 is a schematic side view showing an example of an electrophotographic photoreceptor according to an exemplary embodiment. FIG. 2 is an exploded schematic cross sectional view showing an example of an electrophotographic photoreceptor according to the exemplary embodiment. FIG. 3 is a partial schematic cross sectional view showing an example of an electrophotographic photoreceptor according to the exemplary embodiment.

As shown in FIGS. 1 to 3, an electrophotographic photoreceptor 10 according to the exemplary embodiment has an electrophotographic photoreceptor body 110 and a support member 120 (which may be hereinafter referred to as a flange 120) that supports both ends in the axial direction of the electrophotographic photoreceptor 10.

The electrophotographic photoreceptor body 110 has, for example, a cylindrical electroconductive substrate 111 and a photosensitive layer (which is not shown in the figures) provided on an outer surface of the electroconductive substrate 111.

The cylindrical electroconductive substrate 111 has, for example, openings 112 at both ends in the axial direction.

The thickness Tc at the center portion in the axial direction, specifically a thickness Tc of the portion other than the socket joint portion 113, of the cylindrical electroconductive substrate 111 may be 2 mm or more or approximately 2 mm or more, preferably from 2 mm to 5 mm or from approximately 2 mm to approximately 5 mm, and more preferably from 2 mm to 3 mm or from approximately 2 mm to approximately 3 mm.

The cylindrical electroconductive substrate 111 has, for example, a socket joint portion 113 on each of inner surfaces of both the end portions in the axial direction. Specifically, the cylindrical electroconductive substrate 111 has, for example, a socket joint portion 113 formed by making the thickness Te of the end portion in the axial direction smaller than the thickness Tc of the center portion in the axial direction, thereby providing a step 113A in the circumferential direction of the electroconductive substrate 111 at the boundary between the inner surface of the center portion in the axial direction and the inner surface of the end portion in the axial direction.

The difference between the thickness Tc at the center portion in the axial direction and the thickness Te at the end portion in the axial direction (i.e., the socket joint portion 113) may be, for example, from 0.1 mm to 1.0 mm or from approximately 0.1 mm to approximately 1.0 mm, and preferably from approximately 0.25 mm to approximately 1.0 mm.

The electroconductive substrate 111 may be produced, for example, in such a manner that a cylindrical element tube is provided by drawing, socket joint portions are then formed on the inner surfaces on both end portions in the axial direction of the element tube, and the outer surface of the element tube is subjected to a cutting process or the like while retaining the socket joint portions 113.

The socket joint portion may be formed by various kinds of NC lathes, and both end portions may be cut simultaneously while retaining the outer surface of the element tube.

The flange 120 is positioned, for example, outward in the axial direction of the electrophotographic photoreceptor body 110, and may have a cylindrical flange body 121 having the same diameter as the outer diameter of the electroconductive substrate, and a fitting portion 122 that is fit into the opening 112 of the electroconductive substrate 111.

The flange body 121 and the fitting portion 122 may be, for example, connected and continued coaxially through a circular disk portion 123. A step 121A is provided in the circumferential direction of the flange body 121 at the boundary between the flange body 121 and the fitting portion 122.

The outer diameter of the flange body 121 may be, for example, the same as the outer diameter of the electroconductive substrate 111, and when the fitting portion 122 of the flange 120 is fit into the opening 112 of the electroconductive substrate 111, the flange 120 is positioned outward in the axial direction of the electroconductive substrate 111 coaxially. The flange body 121 has, for example, at the axial center thereof, a shaft 124, which protrudes outward in the axial direction, for retaining rotatably the electrophotographic photoreceptor 10.

The fitting portion 122 is constituted, for example, by a fitting portion body 122A and a protruding portion 122B provided as protruding from the fitting portion body 122A toward the center portion of the electroconductive substrate 111 in the axial direction.

The fitting portion body 122A is, for example, in contact with the inner surface of the end portion in the axial direction of the electroconductive substrate 111, and is, for example, fit thereinto.

The fitting portion body 122A and the protruding portion 122B are, for example, connected and continued coaxially. A step 122C is formed in the circumferential direction of the fitting portion body 122A at the boundary between the fitting portion body 122A and the protruding portion 122B.

The outer diameter R1 of the fitting portion 122 (specifically, the outer diameter of the fitting portion body 122A) is, for example, larger than the diameter R2 of the opening 112 of the electroconductive substrate 111 (specifically, the inner diameter of the electroconductive substrate 111 at the socket joint portion 113) by a range of from 0.01 mm to 0.1 mm or from approximately 0.01 mm to approximately 0.1 mm, preferably from 0.01 mm to 0.08 mm or from approximately 0.01 mm to approximately 0.08 mm, and more preferably from approximately 0.01 mm to approximately 0.06 mm.

In other words, the difference between the outer diameter R1 of the fitting portion 122 (specifically, the outer diameter of the fitting portion body 122A) and the diameter R2 of the opening 112 of the electroconductive substrate 111 (specifically, the inner diameter of the electroconductive substrate 111 at the socket joint portion 113) may be in the aforementioned range.

The outer diameter R1 of the fitting portion 122 (i.e., the outer diameter of the fitting portion body 122A) is the outer diameter before fitting into the opening 112 of the electroconductive substrate 111.

The flange 120 is connected to the electrophotographic photoreceptor body 110 (specifically, the electroconductive substrate 111 thereof) in such a manner that the fitting portion 122 is inserted into the opening 112 of the electroconductive substrate 111, and is fit thereto by making the outer surface of the fitting portion body 122A of the fitting portion 122 in contact with the inner surface (i.e., the socket joint portion 113) at the end portion in the axial direction of the electroconductive substrate 111.

More specifically, the flange 120 is connected to the electrophotographic photoreceptor body 110 (specifically, the electroconductive substrate 111 thereof) in such a manner that the fitting portion body 122A, which has an outer diameter larger than the diameter of the opening 112 (i.e., the diameter of the socket joint portion 113) of the electroconductive substrate 111, of the fitting portion 122 is press-fit into the opening 112 of the electroconductive substrate 111, thereby fitting the fitting portion body 122A into the opening 112 of the electroconductive substrate 111.

At this time, the step 113A in at the end in the axial direction of the electroconductive substrate 111 and the step 122C of the fitting portion 122 of the flange 120 are in contact with each other.

At this time, furthermore, the end surface in the axial direction of the electroconductive substrate 111 and the step 121A of the flange body 121 of the flange 120 are in contact with each other.

The electrophotographic photoreceptor 10 of the exemplary embodiment described above includes:

the electrophotographic photoreceptor body 110: containing the cylindrical electroconductive substrate 111 having the openings 112 at both ends in the axial direction, the cylindrical electroconductive substrate 111 having a thickness of approximately 2 mm or more at the center portion in the axial direction and having the socket joint portion 113 on each of inner surfaces of both the end portions in the axial direction; and a photosensitive layer provided on the outer surface of the electroconductive substrate 111; and the flange 120 (i.e., the support member 120) fit into the openings 112 of the electroconductive substrate 111, having the fitting portion 122 (specifically, the fitting portion body 122A) having an outer diameter that is larger than the diameter of the opening 112 by a range of from approximately 0.01 mm to approximately 0.1 mm, the fitting portion 122 (specifically, the fitting portion body 122A) being press-fit into the opening 112 of the electroconductive substrate 111.

In an image forming apparatus of an electrophotographic system, it is important to enhance the quality of unevenness in image density within an area with the same density, for ensuring high image quality equivalent to an offset printed matter. It has been becoming clear that one of the factors of deterioration of the quality of unevenness in image density is the total runout of the electrophotographic photoreceptor 10, which is caused by fitting between the electroconductive substrate 111 and the flange 120 (i.e., the support member 120) supporting the same in the electrophotographic photoreceptor body 110.

According to the investigations, it has been confirmed that when the total runout of the electrophotographic photoreceptor occurs, unevenness in image density is caused in an image by fluctuations of the spacings and the contact pressures among, for example, the charging device, the developing device, the transfer medium and the like.

The "total runout" herein is defined in JIS B0621 that when an object with a cylindrical surface having a datum axial straight line as an axis thereof is rotated around the datum axial straight line, the extent of displacement of the surface in the designated direction (radial direction) is designated as the total runout.

In the electrophotographic photoreceptor 10 of the exemplary embodiment, it has been found that the total runout is suppressed by the aforementioned structure.

The factor thereof is not completely clear, but it may be considered as follows.

When the thickness of the cylindrical electroconductive substrate 111 (i.e., the thickness thereof at the center portion in the axial direction) is made as thick as approximately 2 mm or more, it is considered that in extrusion, withdrawing and surface cutting, which are ordinary production methods for the electroconductive substrate 111, deterioration in circularity and generation of deflection or the like due to stress opening on cutting the surface of the electroconductive substrate 111 are suppressed from occurring, thereby providing high quality.

When the inner surface at the end portion in the axial direction of the electroconductive substrate 111 having the thickness is processed for socket joint to provide the socket joint portion 113, it is considered that the structure ensures the straightness of the fitting portion 122 (i.e., the fitting portion body 122A) of the flange 120 and the surface of the photosensitive layer provided on the outer surface of the electroconductive substrate 111, and the perpendicularity between the end surface in the axial direction of the fitting portion 122 (i.e., the fitting portion body 122A) of the flange 120 and the axis of the electroconductive substrate 111.

In the case where the socket joint portion 113 is provided on the inner surface at the end portion in the axial direction of the electroconductive substrate 111 having the thickness, and then the outer surface of the electroconductive substrate 111 is cut, it is considered that deterioration of runout due to slight uneven thickness of the electroconductive substrate may be suppressed from occurring.

When the fitting portion 122 (i.e., the fitting portion body 122A), which has an outer diameter larger than the diameter of the opening 112 of the electroconductive substrate 111 by a difference of from approximately 0.01 mm to approximately 0.1 mm, of the flange 120 is press-fit into the opening 112, it is considered that deterioration of total runout due to backlash after press-fitting may be suppressed from occurring.

There is a tendency in recent years that an inexpensive cylindrical electroconductive substrate having a small thickness (for example, a substrate having a thickness of approximately 1 mm) is used in an electrophotographic photoreceptor from the standpoint of reduction in cost and use in offices. Accordingly, it is considered that when a fitting portion, which has an outer diameter larger than a diameter of an opening of a thin cylindrical electroconductive substrate (completed fitting dimension), of a flange is press-fit forcibly into the opening, the electroconductive substrate may be deformed, and the flange may be scraped upon press-fitting.

In the exemplary embodiment, however, the socket joint portion 113 is provided on the inner surface of the cylindrical electroconductive substrate 111 having the large thickness, and thus it is considered that the deformation of the electroconductive substrate 111 and the scraping of the flange 120 may be prevented from occurring even when the fitting portion 122 (i.e., the fitting portion body 122A) with the completed fitting dimension is press-fitted into the opening 112 of the cylindrical electroconductive substrate 111.

It is considered that the total runout of the electrophotographic photoreceptor 10 of the exemplary embodiment may be suppressed.

Furthermore, the electrophotographic photoreceptor 10 of the exemplary embodiment may maintain the suppression of total runout for a prolonged period of time, and may be achieved by the simple structure containing the electroconductive substrate 111 and the flange 120.

Accordingly, an image forming apparatus or a process cartridge each having the electrophotographic photoreceptor 10 of the exemplary embodiment provides an image that is suppressed in unevenness in image density due to total runout.

The components constituting the electrophotographic photoreceptor 10 of the exemplary embodiment will be described in detail below.

Flange (Support Member)

The flange 120 is constituted by the flange body 121 and the fitting portion 122.

The flange 120 may be, for example, formed of a resin (such as a polycarbonate resin, a polyester resin, a polyamide resin, an ABS resin and the like, which are referred to as engineering plastics) or the like.

Specifically, the flange 120 may be formed of the resin by cutting process, or by integral molding, such as injection molding and extrusion molding.

The flange 120 contains a resin and glass fibers (the content of which may be from 20 to 40% by mass or from approximately 20 to approximately 40% by mass, and preferably from approximately 30 to approximately 40% by mass), and the outer surface of the fitting portion body 122A of the fitting portion 122 (i.e., the surface of the fitting portion that is in contact with the inner surface of the end portion in the axial direction) may have an arithmetic average roughness Ra of from 0.5 μm to 0.8 μm or from approximately 0.5 μm to approximately 0.8 μm, and preferably from approximately 0.6 μm to approximately 0.7 μm).

The content of the glass fibers herein is a content with respect to the resin.

The glass fibers may have, for example, a diameter of from 6 μm to 15 μm or from approximately 6 μm to approximately 15 μm, and preferably from approximately 8 μm to approximately 10 μm. The glass fibers may have a fiber length of from approximately 1 mm to approximately 4 mm, and preferably from approximately 2 mm to approximately 3 mm.

The glass fibers may have a surface subjected to various surface treatments (such as treatments with an epoxy compound, a silicone compound, an acrylic compound and the like).

When the resin constituting the flange 120 contains the glass fibers in an amount within the range, it is considered that the flange 120 is prevented from suffering thermal deformation and distortion caused on shaping (such as cutting), whereby the circularity and the high coaxiality of the flange 120 are ensured, and simultaneously, the flange 120 withstands environmental fluctuation, such as heat, and maintains the shape thereof, upon using for a prolonged period of time.

When the resin constituting the flange 120 contains the glass fibers in an amount within the range, furthermore, it is considered that an arithmetic average roughness Ra within the aforementioned range is facilitated to be imparted to the outer surface of the fitting portion body 122A of the fitting portion 122.

When the arithmetic average roughness Ra of the outer surface of the fitting portion body 122A of the fitting portion 122 of the flange 120 is in the aforementioned range, it is considered that friction on press-fitting the fitting portion 122 of the flange 120 into the opening 112 of the electroconductive substrate 111 is lowered, thereby preventing the electroconductive substrate 111 and the flange 120 (the fitting portion 122) from being deformed or broken.

When the arithmetic average roughness Ra is too small, the outer surface of the fitting portion 122 (the fitting portion body 122A) may be get scratched on the inner surface of the end portion in the axial direction of the electroconductive substrate 111 upon press-fitting the fitting portion 122 of the flange 120 into the opening 112 of the electroconductive substrate 111, thereby deforming or breaking the electroconductive substrate 111 and the flange 120 (the fitting portion 122). When the arithmetic average roughness Ra is too large, on the other hand, the outer surface of the fitting portion 122 (the fitting portion body 122A) tends to be scraped upon press-fitting the fitting portion 122 of the flange 120 into the opening 112 of the electroconductive substrate 111, and scrapes are accumulated between the inner surface of the end portion in the axial direction of the electroconductive substrate 111 and the fitting portion 122 (the fitting portion body 122A) of the flange 120, thereby deteriorating finally the total runout of the electrophotographic photoreceptor 10.

It is thus considered that the total runout of the electrophotographic photoreceptor 10 may be suppressed, and the electroconductive substrate 111 and the flange 120 (the fitting portion 122) may be prevented from being deformed or broken when the flange 120 has the aforementioned structure.

The arithmetic average roughness Ra herein is a value measured with a probe surface roughness measuring device (such as Surfcom 1400A, available from Tokyo Seimitsu Co., Ltd.). The measurement conditions therefor may be an evaluation length Ln of 4 mm, a standard length L of 0.8 mm and a cutoff value of 0.8 mm, according to JIS B0601 (1994).

Electrophotographic Photoreceptor Body

The electrophotographic photoreceptor body 110 may have, for example, a cylindrical electroconductive substrate 111 and a photosensitive layer provided on the outer surface of the electroconductive substrate 111.

The electrophotographic photoreceptor body 110 is not particularly limited as far as it contains the aforementioned structure, and known structures may also be employed, such as a structure containing an underlayer provided under the photosensitive layer, and a structure containing a surface protective layer provided on the photosensitive layer, and the like.

Figure 4:
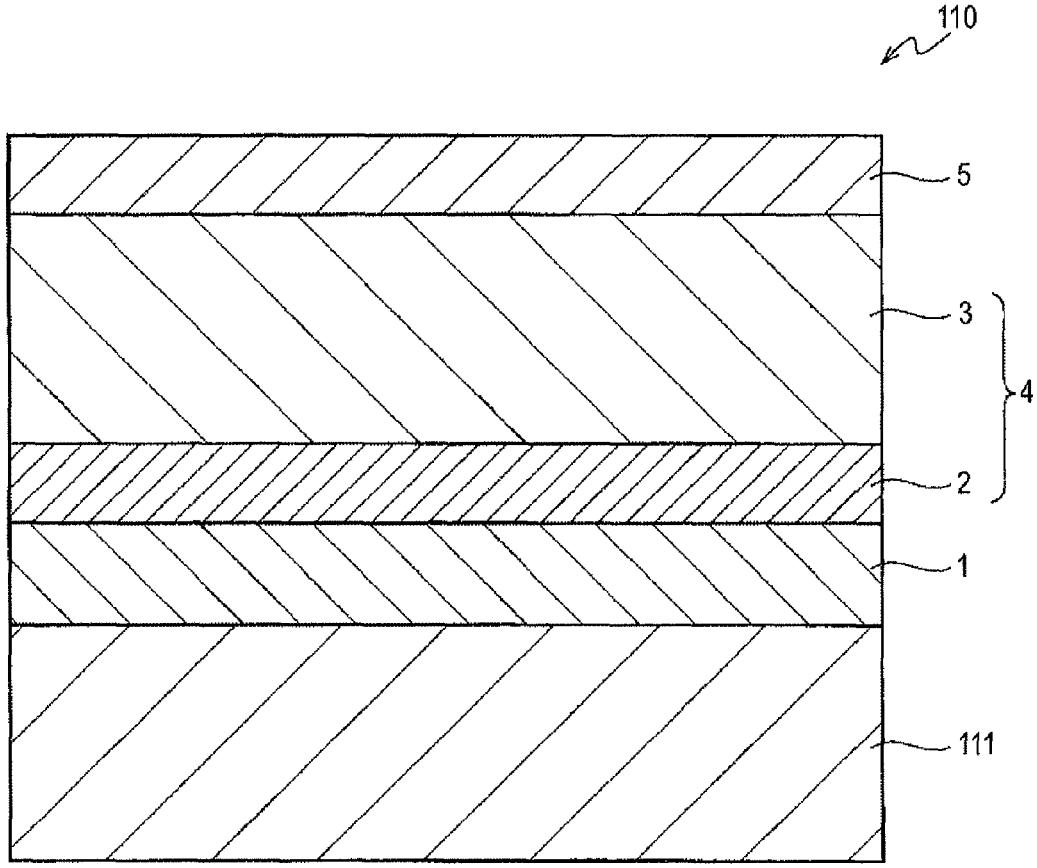
FIG. 4 is a schematic partial cross sectional view showing an example of an electrophotographic photoreceptor body according to an exemplary embodiment.
Figure 5:
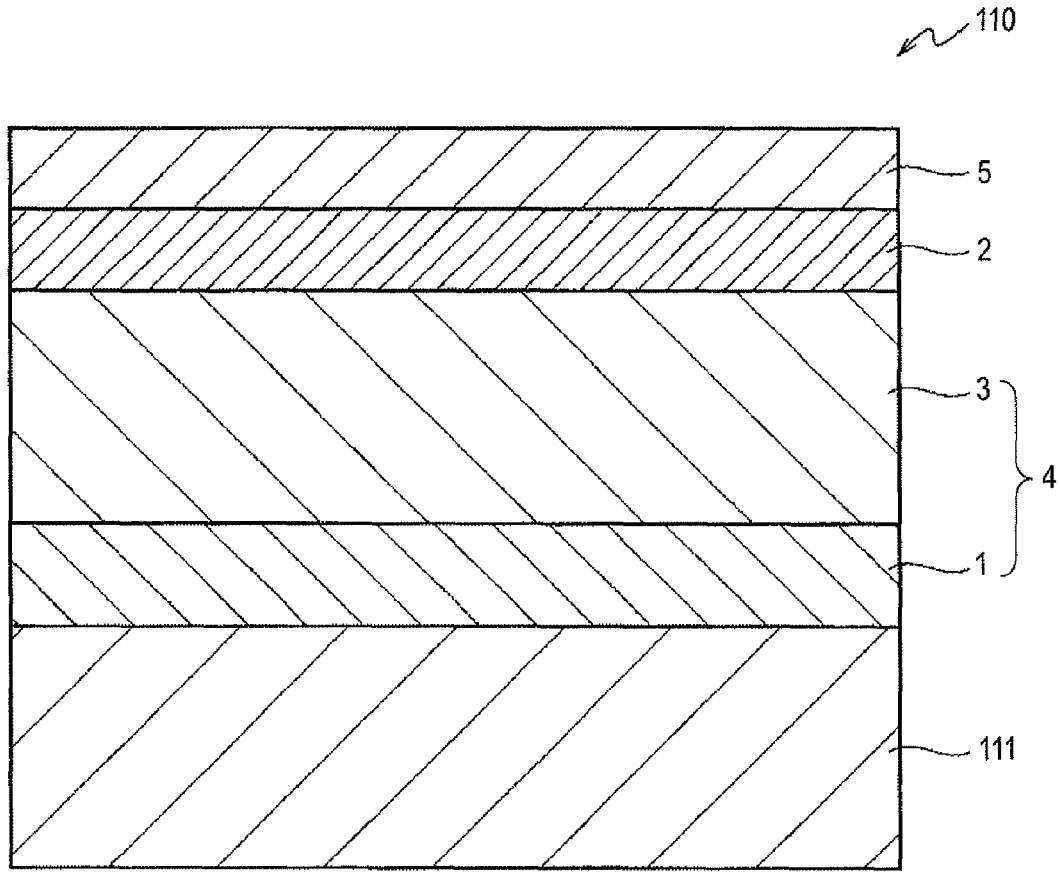
FIG. 5 is a schematic partial cross sectional view showing another example of an electrophotographic photoreceptor body according to an exemplary embodiment.
Figure 6:
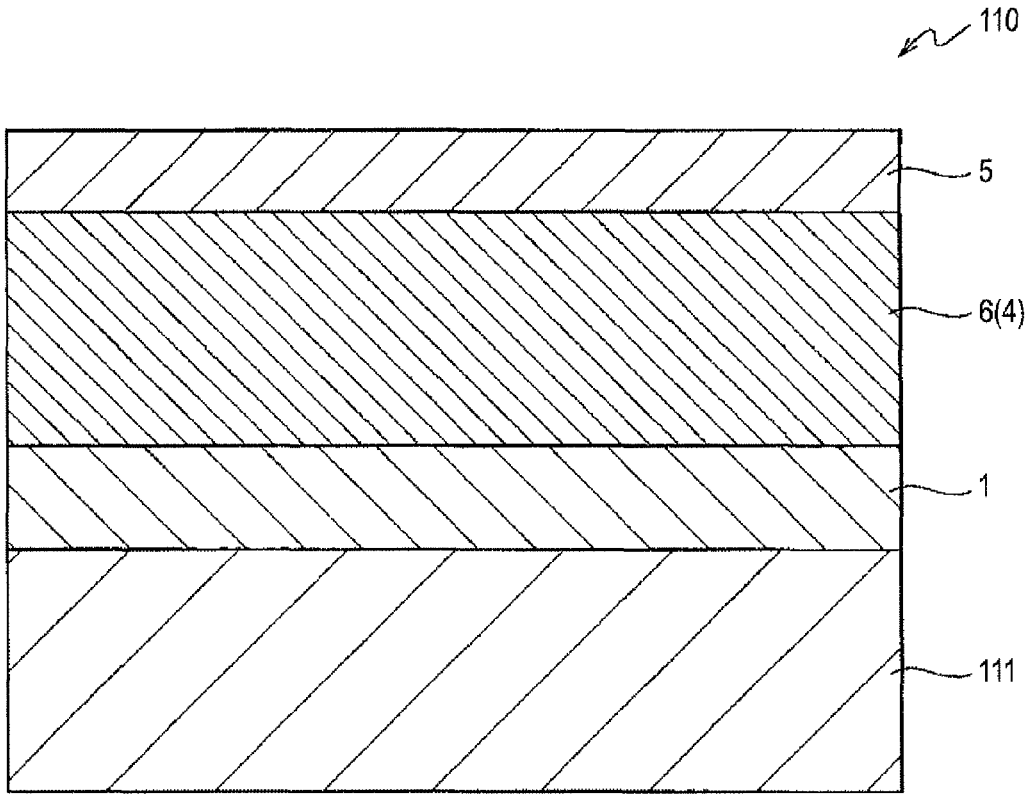
FIG. 6 is a schematic partial cross sectional view showing still another example of an electrophotographic photoreceptor body according to an exemplary embodiment.

Specific examples of the electrophotographic photoreceptor body 110 include ones shown in FIGS. 4 to 6.

An electrophotographic photoreceptor body 110 shown in FIG. 4 has an electroconductive substrate 111 having an under layer 1 formed thereon, a photosensitive layer 4 containing a charge generating layer 2 and a charge transporting layer 3 provided on the under layer 1, and a surface protective layer 5 layer is provided as the outermost layer.

An electrophotographic photoreceptor body 110 shown in FIG. 5 has a photosensitive layer 4 containing a charge generating layer 2 and a charge transporting layer 3, which are separated from each other in function, as similar to the electrophotographic photoreceptor body 110 shown in FIG. 4, and the charge transporting layer 3, the charge generating layer 2 and a surface protective layer 5 are provided on the underlayer 1 sequentially in this order.

An electrophotographic photoreceptor body 110 shown in FIG. 6 has, as a photosensitive layer 4, a single layer photosensitive layer 6 (i.e., a charge generating/transporting layer) containing both a charge generating material and a charge transporting material in one layer, and a surface protective layer 5 is provided on the single layer photosensitive layer 6.

In the electrophotographic photoreceptor body 110, the underlayer 1 and the surface protective layer 5 may be provided depending on necessity.

The electrophotographic photoreceptor body 110 may have an abrasion amount of the outermost layer thereof of 15 nm or less or approximately 15 nm or less (preferably approximately 10 nm or less, and more preferably approximately 5 nm or less) per 1,000 rotations of the electrophotographic photoreceptor body.

When the thickness of the outermost layer of the electrophotographic photoreceptor body 110 is decreased by abrasion upon repeated image formation, the photosensitivity of the photosensitive layer may be changed to decrease the charging property.

Accordingly, when the abrasion amount of the outermost layer of the electrophotographic photoreceptor body 110 is in the range, the charging property of the electrophotographic photoreceptor body 110 may be prevented from being decreased upon repeated image formation. Consequently, images having printed quality maintained may be obtained repeatedly.

For achieving the abrasion amount of the outermost layer in the range, for example, a surface protective layer 5 containing a crosslinked product (i.e., a cured product) is provided as the outermost layer, or in alternative, in the case where a surface protective layer 5 is not provided, the layer constituting the outermost layer (for example, the charge transporting layer or the single layer photosensitive layer 6) is constituted by a layer containing a crosslinked product (i.e., a cured product).

The abrasion amount of the outermost layer of the electrophotographic photoreceptor body 110 per 1,000 rotations of the electrophotographic photoreceptor body is a value measured in the following manner.

An electrophotographic photoreceptor is mounted on an image forming apparatus, a black image with an image density of 5% is printed on A3-size ordinary paper in an amount of 100,000 sheets or more while the rotation number of the photoreceptor is measured. The difference between the thicknesses of the outermost layer of the electrophotographic photoreceptor before and after the image formation is obtained, and is converted to the abrasion amount per 1,000 rotations of the electrophotographic photoreceptor body by using the difference and the rotation number.

The electrophotographic photoreceptor body 110 shown in FIG. 4 as a representative example will be described for the components thereof below. The symbols in the figure are omitted.

Electroconductive Substrate

Examples of the electroconductive substrate include metal tubes constituted by a metal or an alloy, such as aluminum, copper, zinc, stainless steel, chromium, nickel, molybdenum, vanadium, indium, gold and platinum. The term "electroconductive" referred herein means that a material has a volume resistivity of less than $10^{13}$ Ωcm.

In the case where a metal tube is used as the electroconductive substrate, the surface thereof may be an element tube as it is or may be subjected to such a process in advance as mirror-surface finishing, etching, anodic oxidation, rough cutting, centerless grinding, sandblasting and wet honing.

Underlayer

The underlayer may be provided depending on necessity for such purposes as prevention of light reflection on the surface of the electroconductive substrate, and prevention of unnecessary injection of the carrier from the electroconductive substrate to the photosensitive layer.

The underlayer may contain, for example, a binder resin and, depending on necessity, other additives.

Examples of the binder resin contained in the underlayer include known polymer resins, such as an acetal resin, e.g., polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin and a urethane resin, a charge transporting resin having a charge transporting group, and an electroconductive resin, such as polyaniline. Among these, a resin that is insoluble in the solvent used for coating the upper layer may be used, and in particular, a phenol resin, a phenol-formaldehyde resin, a melamine resin, a urethane resin, an epoxy resin and the like may be preferably used.

The underlayer may contain a metal compound, such as a silicon compound, an organozirconium compound, an organotitatium compound and an organoaluminum compound.

The ratio of the metal compound and the binder resin is not particularly limited, and may be arbitrarily determined within such a range that the intended properties of the electrophotographic photoreceptor body 110 is obtained.

The underlayer may contain resin particles for controlling the surface roughness. Examples of the resin particles include silicone resin particles and crosslinked polymethyl methacrylate (PMMA) resin particles. The surface of the underlayer may be polished after forming, for controlling the surface roughness. Examples of the polishing method include buff polishing, sandblasting, wet honing and grinding.

Examples of the constitution of the underlayer include one containing at least a binder resin and electroconductive particles. The electroconductive particles may have, for example, electroconductivity of a volume resistivity of less than approximately $10^7$ Ωcm.

Examples of the electroconductive particles include metal particles (such as particles of aluminum, copper, nickel and silver), electroconductive metal oxide particles (such as particles of antimony oxide, indium oxide, tin oxide and zinc oxide), and electroconductive substance particles (such as carbon fibers, carbon black and particles of graphite). Among these, electroconductive metal oxide particles may be preferably used. The electroconductive particles may be used as a mixture of two or more kinds thereof mixed.

The electroconductive particles may be subjected to a surface treatment, such as a treatment with a hydrophobic agent (such as a coupling agent), for controlling the resistance.

The content of the electroconductive particles may be, for example, from approximately 10 to approximately 80% by mass, and preferably from approximately 40 to approximately 80% by mass, based on the binder resin.

Upon forming the underlayer, a coating composition for forming an underlayer containing the aforementioned components and a solvent may be used.

Examples of the method for dispersing the particles in the coating composition for forming an underlayer include a media dispersing device, such as a ball mill, a vibration ball mill, an attritor, a sand mill and a horizontal sand mill, and a dispersing device without a medium, such as a stirrer, an ultrasonic dispersing device, a roll mill and a high-pressure homogenizer. Examples of the high-pressure homogenizer include a collision type, in which a dispersion liquid is dispersed by subjecting to liquid-liquid collision or liquid-wall collision, and a penetration type, in which a dispersion liquid is dispersed by penetrating through a minute flow path.

Examples of the method for coating the coating composition for forming an underlayer on the electroconductive substrate include a dip coating method, a toss coating method, a wire bar coating method, a spray coating method, a blade coating method, a knife coating method and a curtain coating method.

The thickness of the underlayer may be approximately 15 μm or more, and preferably from approximately 20 μm to approximately 50 μm.

While not shown in the figure, an intermediate layer may be further provided between the underlayer and the photosensitive layer. Examples of a binder resin used in the intermediate layer include polymer resins, such as an acetal resin, e.g., polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin and a melamine resin, and an organometal compound containing such an atom as zirconium, titanium, aluminum, manganese and silicon. These compound may be used solely or as a mixture or a polycondensation product of plural kinds of the compounds. Among these, an organometal compound containing zirconium or silicon may be used since the compound has a low residual potential providing less potential change due to an environment, and is small in potential change upon repeated use.

Upon forming the intermediate layer, a coating composition for forming an intermediate layer containing the aforementioned components and a solvent may be used.

Examples of the method for coating the coating composition for forming an intermediate layer include ordinary coating methods, such as a dip coating method, a toss coating method, a wire bar coating method, a spray coating method, a blade coating method, a knife coating method and a curtain coating method.

The intermediate layer exerts a function of an electric blocking layer, in addition to improvement of the coating property of the upper layer. When the thickness of the intermediate layer is too large, the layer may provide too a strong electric barrier, which may cause desensitization and increase in potential upon repeated use. Accordingly, the thickness of the intermediate layer may be in a range of from approximately 0.1 μm to approximately 3 μm when the intermediate layer is provided. In this case, the intermediate layer may be used as an underlayer.

Charge Generating Layer

The charge generating layer may contain, for example, a charge generating material and a binder resin. Examples of the charge generating material include a phthalocyanine pigment, such as metal-free phthalocyanine, chlorogallium phthalocyanine, hydroxygallium phthalocyanine, dichlorotin phthalocyanine and titanyl phthalocyanine, and particularly include chlorogallium phthalocyanine crystals having distinct diffraction peaks at Bragg angles (2θ±0.2°) to the CuKα characteristic X-ray of 7.4°, 16.6°, 25.5° and 28.3°, metal-free phthalocyanine crystals having distinct diffraction peaks at Bragg angles (2θ±0.2°) to the CuKα characteristic X-ray of 7.7°, 9.3°, 16.9°, 17.5°, 22.4° and 28.8°, hydroxygallium phthalocyanine crystals having distinct diffraction peaks at Bragg angles (2θ±0.2°) to the CuKα characteristic X-ray of 7.5°, 9.9°, 12.5°, 16.3°, 18.6°, 25.1° and 28.3°, and titanyl phthalocyanine crystals having distinct diffraction peaks at Bragg angles (2θ±0.2°) to the CuKα characteristic X-ray of 9.6°, 24.1° and 27.2°. Examples of the charge generating material also include a quinone pigment, a perylene pigment, an indigo pigment, a bisbenzoimidazole pigment, an anthrone pigment and a quinacridone pigment. The charge generating material may be used solely or as a mixture of two or more kinds thereof.

Examples of the binder resin constituting the charge generating layer include a bisphenol A type of bisphenol Z type polycarbonate resin, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin and a poly-N-vinylcarbazole resin. The binder resin may be used solely or as a mixture of two or more kinds thereof.

The mixing ratio of the charge generating material and the binder resin may be, for example, from approximately 10/1 to approximately 1/10.

Upon forming the charge generating layer, a coating composition for forming a charge generating layer containing the aforementioned components and a solvent may be used.

Examples of the method for dispersing the particles (such as a charge generating material) in the coating composition for forming a charge generating layer include a media dispersing device, such as a ball mill, a vibration ball mill, an attritor, a sand mill and a horizontal sand mill, and a dispersing device without a medium, such as a stirrer, an ultrasonic dispersing device, a roll mill and a high-pressure homogenizer. Examples of the high-pressure homogenizer include a collision type, in which a dispersion liquid is dispersed by subjecting to liquid-liquid collision or liquid-wall collision at high pressures, and a penetration type, in which a dispersion liquid is dispersed by penetrating through a minute flow path at high pressures.

Examples of the method for coating the coating composition for forming a charge generating layer on the underlayer include a dip coating method, a toss coating method, a wire bar coating method, a spray coating method, a blade coating method, a knife coating method and a curtain coating method.

The thickness of the charge generating layer may be from approximately 0.01 μm to approximately 5 μm, and preferably from approximately 0.05 μm to approximately 2.0 μm.

Charge Transporting Layer

The charge transporting layer may contain, for example, a charge transporting material and, depending on necessity, a binder resin. In the case where the charge transporting layer constitutes the outermost layer, the charge transporting layer may contain fluorine resin particles having the specific surface area mentioned above.

Examples of the charge transporting material include a hole transporting material, examples of which include an oxadiazole derivative, such as 2,5-bis(p-diethylaminophenyl)-1,3,4-oxadiazole, a pyrazoline derivative, such as 1,3,5-triphenylpyrazoline and 1-(pyridyl-(2))-3-(p-diethylaminostyryl)-5-(p-diethylaminostyryl)pyrazoline, an aromatic tertiary amino compound, such as triphenylamine, N,N'-bis(3,4-dimethylphenyl)biphenyl-4-amine, tri(p-methylphenyl)aminyl-4-amine and dibenzylaniline, an aromatic tertiary diamino compound, such as N,N'-bis(3-methylphenyl)-N,N'-diphenylbendizine, a 1,2,4-triazine derivative, such as 3-(4'-dimethylaminophenyl)-5,6-di-(4'-methoxyphenyl)-1,2,4-triazine, a hydrazone derivative, such as 4-diethylaminobenzaldehyde-1,1-diphenylhydrazone, a quinazoline derivative, such as 2-phenyl-4-styrylquinazoline, a benzofuran derivative, such as 6-hydroxy-2,3-di(p-methoxyphenyl)benzofuran, an α-stilbene derivative, such as p-(2,2-diphenylvinyl)-N,N-diphenylaniline, an enamine derivative, a carbazole derivative, such as N-ethylcarbazole, and poly-N-vinylcarbazole and a derivative thereof, an electron transporting material, examples of which include a quinone compound, such as chloranil and bromoanthraquinone, a tetracyanoquinodimethane compound, a fluorenone compound, such as 2,4,7-trinitrofluorenone and 2,4,5,7-tetranitro-9-fluorenone, a xanthone compound and a thiophene compound, and a polymer having a group constituted by the aforementioned compounds on the main chain or the side chain thereof. The charge transporting material may be used solely or as a combination of two or more kinds thereof.

Examples of the binder resin constituting the charge transporting layer include an insulating resin, examples of which include a bisphenol A type or bisphenol Z type polycarbonate resin, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin and chorine rubber, and an organic photoconductive polymer, examples of which include polyvinylcarbazole, polyvinylanthracene and polyvinylpyrene. The binder resin may be used solely or as a mixture of two or more kinds thereof.

The mixing ratio of the charge transporting material and the binder resin may be, for example, from approximately 10/1 to approximately 1/5.

Upon forming the charge transporting layer, a coating composition for forming a charge transporting layer containing the aforementioned components and a solvent may be used.

Examples of the method for dispersing the particles (such as fluorine resin particles) in the coating composition for forming a charge transporting layer include a media dispersing device, such as a ball mill, a vibration ball mill, an attritor, a sand mill and a horizontal sand mill, and a dispersing device without a medium, such as a stirrer, an ultrasonic dispersing device, a roll mill and a high-pressure homogenizer. Examples of the high-pressure homogenizer include a collision type, in which a dispersion liquid is dispersed by subjecting to liquid-liquid collision or liquid-wall collision at high pressures, and a penetration type, in which a dispersion liquid is dispersed by penetrating through a minute flow path at high pressures.

Examples of the method for coating the coating composition for forming a charge transporting layer on the charge generating layer include ordinary methods, such as a dip coating method, a toss coating method, a wire bar coating method, a spray coating method, a blade coating method, a knife coating method and a curtain coating method.

The thickness of the charge transporting layer may be from approximately 5 μm to approximately 50 μm, and preferably from approximately 10 μm to approximately 40 μm.

Surface Protective Layer

The surface protective layer is the outermost layer of the electrophotographic photoreceptor body 110, and is provided for imparting resistance to abrasion and damage on the outermost surface, and for enhancing the transferring efficiency of a toner.

Accordingly, the surface protective layer may be a layer containing a crosslinked product (i.e., a cured product), and the layer may have a known constitution.

The surface protective layer may be constituted by a cured film of at least one selected from a guanamine compound and a melamine compound, and a charge transporting material having at least one substituent selected from —OH, —$OCH_3$, —$NH_2$, —SH and —COOH. Specifically, the surface protective layer may contain a crosslinked product formed by using a coating composition containing at least one selected from a guanamine compound and a melamine compound, and a charge transporting material having at least one substituent selected from —OH, —$OCH_3$, —$NH_2$, —SH and —COOH (which may be hereinafter referred to as a particular charge transporting material.

The guanamine compound will be described.

The guanamine compound is a compound having a guanamine skeleton (structure), and examples thereof include acetoguanamine, benzoguanamine, formoguanamine, steroguanamine, spiroguanamine and cyclohexylguanamine.

The guanamine compound may be at least one of a compound represented by the following general formula (A) or a polymeric compound thereof. The polymeric compound herein may be an oligomer obtained by oligomerizing the compound represented by the general formula (A) as a repeating unit, and the polymerization degree thereof may be, for example, from approximately 2 to approximately 200, and preferably from approximately 2 to approximately 100. The compound represented by the general formula (A) may be used solely or as a combination of two or more kinds thereof. In particular, when two or more kinds of the compounds represented by the general formula (A) are used after mixing or as a polymeric compound (oligomer) containing the compounds as repeating units, the solubility to a solvent may be enhanced.

(A)

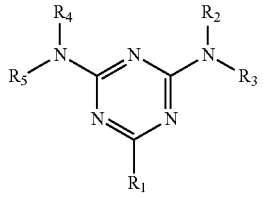

In the general formula (A), $R_1$ represents a linear or branched alkyl group having from 1 to 10 carbon atoms, a substituted or unsubstituted phenyl group having from 6 to 10 carbon atoms or a substituted or unsubstituted alicyclic hydrocarbon group having from 4 to 10 carbon atoms. $R_2$ to $R_5$ each independently represent hydrogen, —$CH_2$—OH or —$CH_2$—O—$R_6$. $R_6$ represents a linear or branched alkyl group having from 1 to 10 carbon atoms.

In the general formula (A), the alkyl group represented by $R_1$ has from 1 to 10 carbon atoms, preferably from 1 to 8 carbon atoms, and more preferably from 1 to 5 carbon atoms. The alkyl group may be linear or branched.

In the general formula (A), the phenyl group represented by $R_1$ has from 6 to 10 carbon atoms, and preferably from 6 to 8 carbon atoms. Examples of the substituent substituted on the phenyl group include a methyl group, an ethyl group and a propyl group.

In the general formula (A), the alicyclic hydrocarbon group represented by $R_1$ has from 4 to 10 carbon atoms, and preferably from 5 to 8 carbon atoms. Examples of the substituent substituted on the alicyclic hydrocarbon group include a methyl group, an ethyl group and a propyl group.

In the general formula (A), the alkyl group represented by $R_6$ in —$CH_2$—O—$R_6$ represented by $R_2$ to $R_5$ has from 1 to 10 carbon atoms, preferably from 1 to 8 carbon atoms, and more preferably from 1 to 6 carbon atoms. The alkyl group may be linear or branched. Preferred examples of the alkyl group include a methyl group, an ethyl group and a butyl group.

Preferred examples of the compound represented by the general formula (A) include a compound, in which $R_1$ represents a substituted or unsubstituted phenyl group having from 6 to 10 carbon atoms, $R_2$ to $R_5$ each independently represent —$CH_2$—O—$R_6$. $R_6$ preferably selected from a methyl group and a n-butyl group.

The compound represented by the general formula (A) may be synthesized, for example, according to a known method (for example, Jikken Kagaku Kouza (Experimental Chemistry Course), 4th ed., vol. 28, p. 430, edited by The Chemical Society of Japan) using guanamine and formaldehyde.

Specific examples of the compound represented by the general formula (A) include exemplary compounds (A)-1 to (A)-42 shown below, but the exemplary embodiment is not limited to the exemplary compounds. The exemplary compounds are all monomers, polymeric compounds (oligomers) containing the monomers as a constitutional component may also be included. In the exemplary compounds, the symbol Me represents a methyl group, Bu represents a butyl group, and Ph represents a phenyl group.

(A)-1

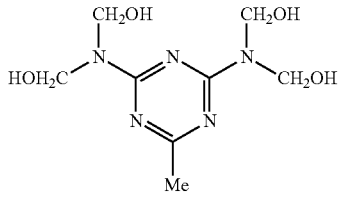

(A)-2

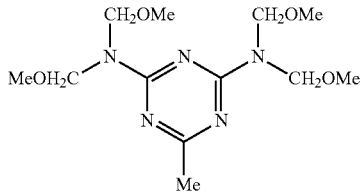

(A)-3

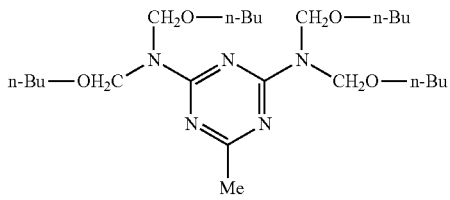

(A)-4

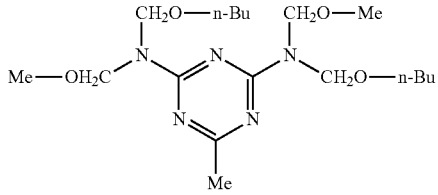

-continued
(A)-5
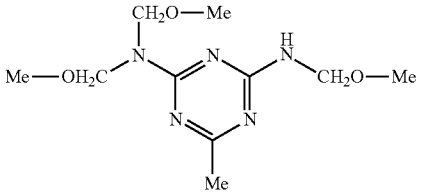
(A)-6
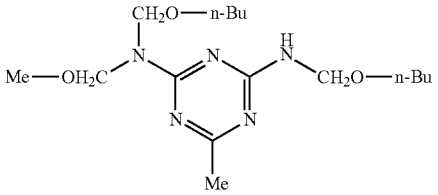
(A)-7
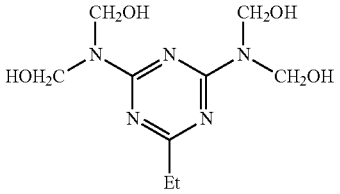
(A)-8
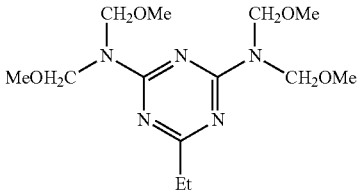
(A)-9
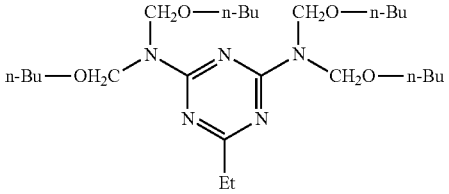
(A)-10
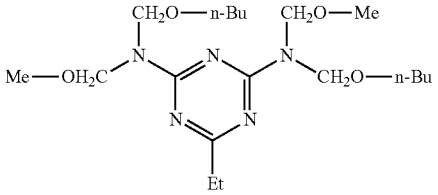
(A)-11
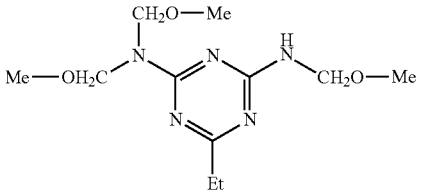
(A)-12
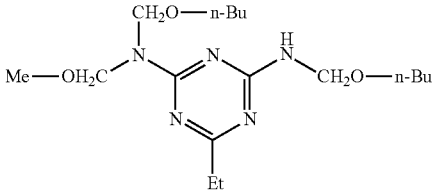
-continued
(A)-13
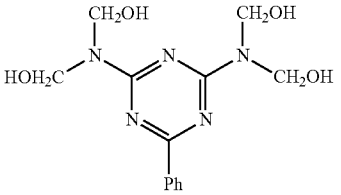
(A)-14
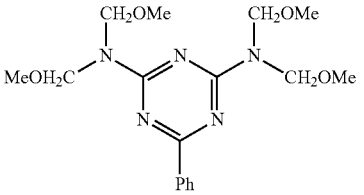
(A)-15
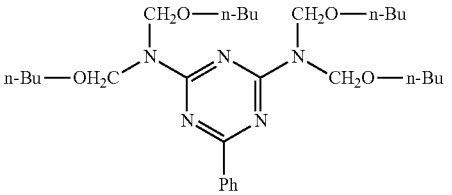
(A)-16
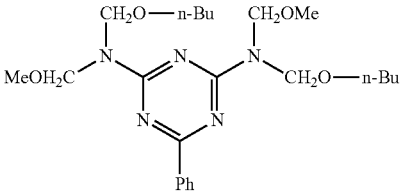
(A)-17
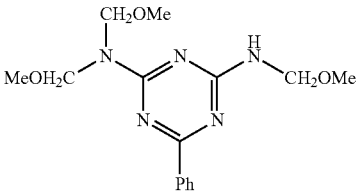
(A)-18
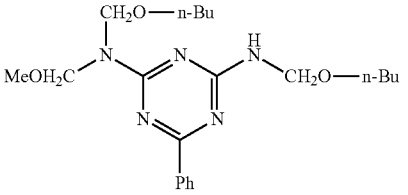
(A)-19
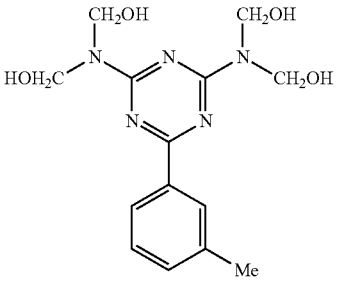

-continued
(A)-20
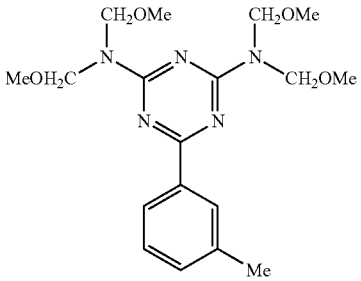
(A)-21
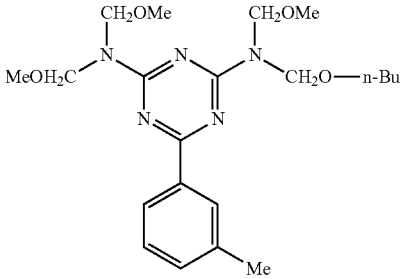
(A)-22
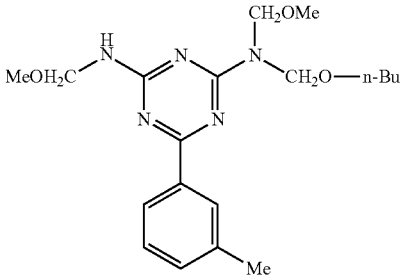
(A)-23
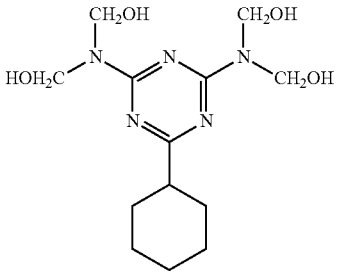
(A)-24
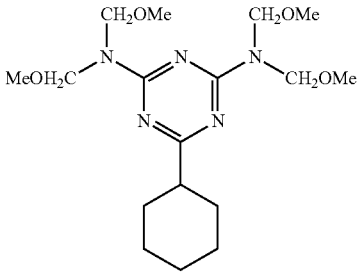
-continued
(A)-25
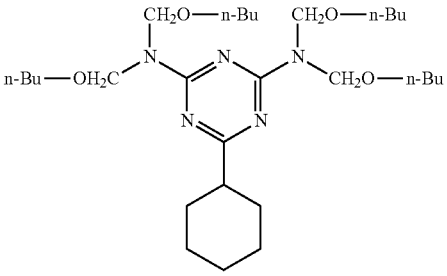
(A)-26
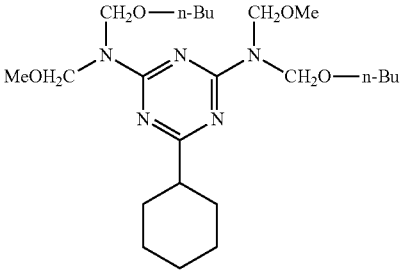
(A)-27
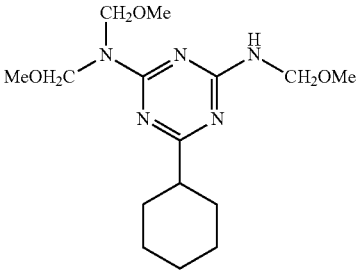
(A)-28
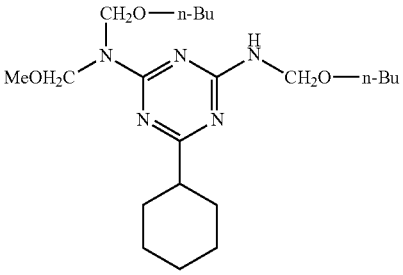
(A)-29
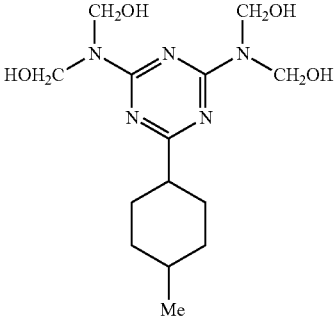

-continued
(A)-30
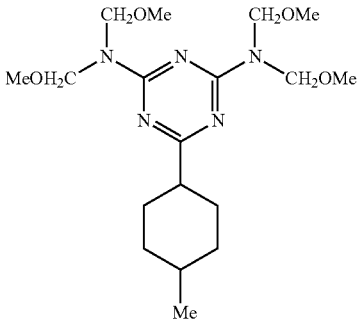
(A)-31
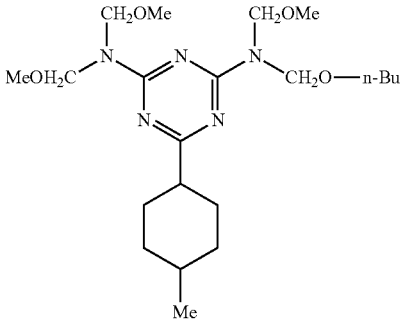
(A)-32
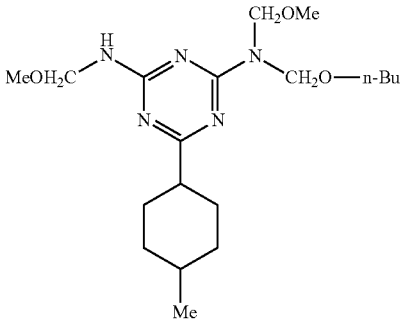
(A)-33
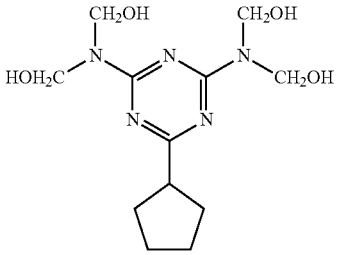
(A)-34
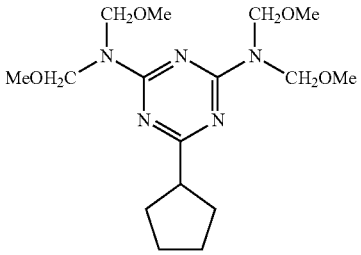
-continued
(A)-35
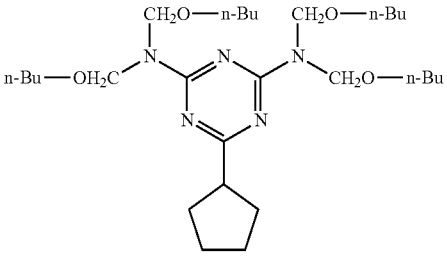
(A)-36
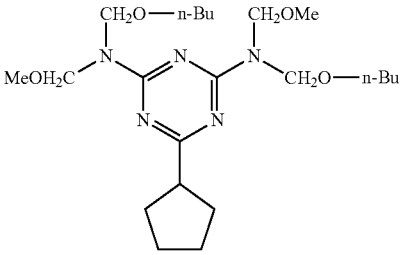
(A)-37
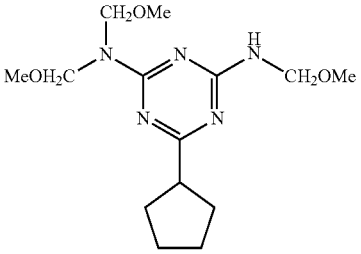
(A)-38
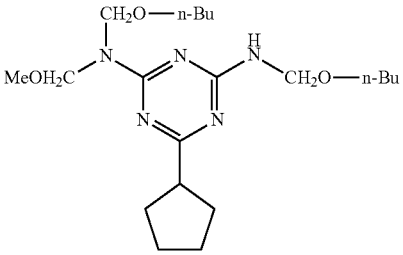
(A)-39
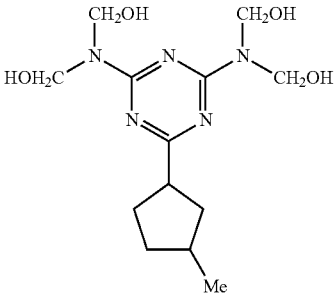
(A)-40
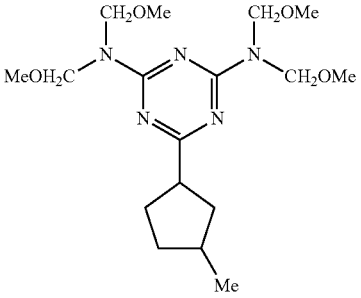

-continued (A)-41

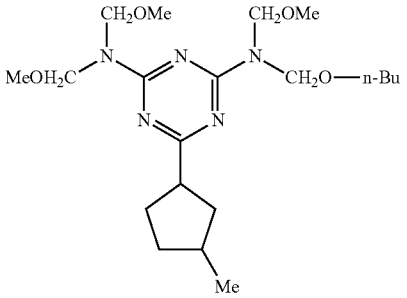

(A)-42

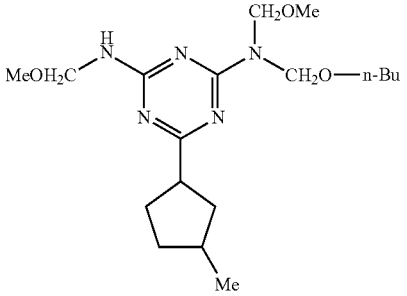

Examples of commercially available products of the compound represented by the general formula (A) include Super Beckamine, a trade name, L-148-55, 13-535, L-145-60 and TD-126, all available from Dainippon Ink And Chemicals, Inc., and Nikarak BL-60 and Nikarak BX-4000, all available from Nippon Carbide Industries, Co., Inc.

The compound represented by the general formula (A) (including polymeric compounds thereof) may be dissolved in a suitable solvent, such as toluene, xylene, ethyl acetate or the like, and rinsed with distilled water, ion exchanged water or the like, or may be treated with an ion exchange resin, for removing the influence of the residual catalyst after synthesis or procurement of a commercially available product.

The melamine compound will be described.

The melamine compound may have a melamine skeleton (structure) and may be at least one of a compound represented by the following general formula (B) and a polymeric compound thereof. The polymeric compound herein may be, as similar to the compound represented by the general formula (A), an oligomer obtained by oligomerizing the compound represented by the general formula (B) as a repeating unit, and the polymerization degree thereof may be, for example, from approximately 2 to approximately 200, and preferably from approximately 2 to approximately 100. The compound represented by the general formula (B) may be used solely or as a combination of two or more kinds thereof, and may also be used in combination with the compound represented by the general formula (A) or a polymeric compound thereof. In particular, when two or more kinds of the compounds represented by the general formula (B) are used after mixing or as a polymeric compound (oligomer) containing the compounds as repeating units, the solubility to a solvent may be enhanced.

(B)

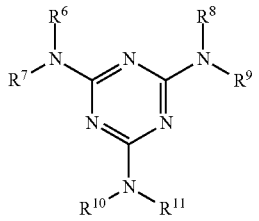

In the general formula (B), $R^6$ to $R^{11}$ each independently represent hydrogen, —$CH_2$—OH, —$CH_2$—O—$R^{12}$ or —O—$R^{12}$, and $R^{12}$ represents an alkyl group having from 1 to 5 carbon atoms, which may be branched. Examples of the alkyl group include a methyl group, an ethyl group and a butyl group.

The compound represented by the general formula (B) may be synthesized, for example, according to a known method (for example, Jikken Kagaku Kouza (Experimental Chemistry Course), 4th ed., vol. 28, p. 430, edited by The Chemical Society of Japan) using melamine and formaldehyde.

Specific examples of the compound represented by the general formula (B) include exemplary compounds (B)-1 to (B)-8 shown below, but the exemplary embodiment is not limited to the exemplary compounds. The exemplary compounds are all monomers, polymeric compounds (oligomers) containing the monomers as a constitutional unit may also be included.

(B)-1

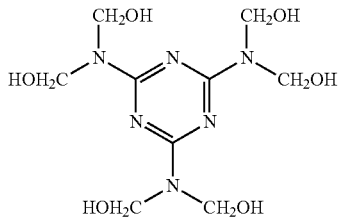

(B)-2

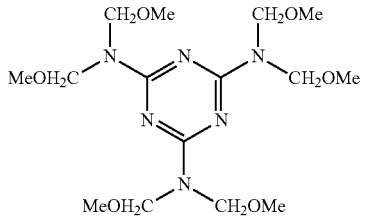

(B)-3

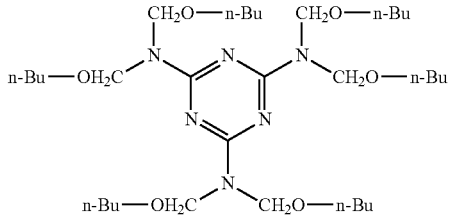

-continued (B)-4

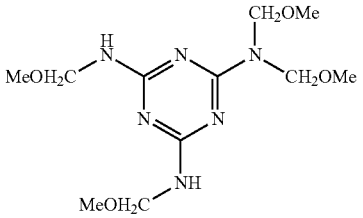

(B)-5

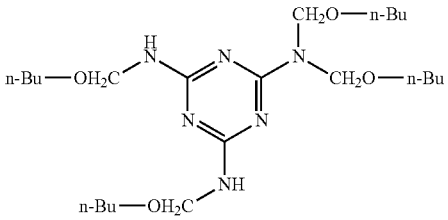

(B)-6

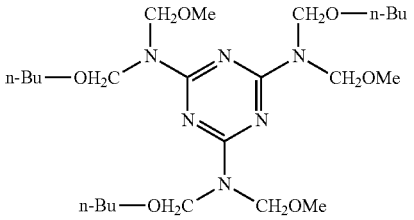

(B)-7

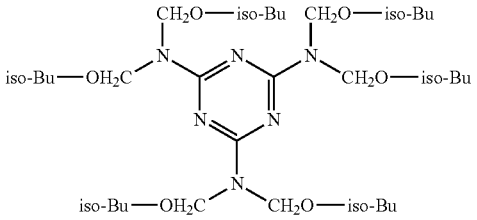

(B)-8

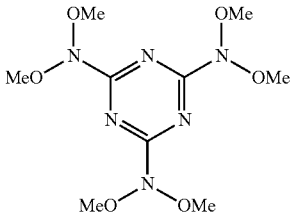

Examples of commercially available products of the compound represented by the general formula (B) include Super Melamine No. 90, available from NOF Corporation, Super Beckamine, a trade name, TD-139-60, available from Dainippon Ink And Chemicals, Inc., U-VAN 2020, available from Mitsui Chemicals, Inc., Sumitex Resin M-3, available from Sumitomo Chemical Co., Ltd., and Nikarak MW-30, available from Nippon Carbide Industries, Co., Inc.

The compound represented by the general formula (B) (including polymeric compounds thereof) may be dissolved in a suitable solvent, such as toluene, xylene, ethyl acetate or the like, and rinsed with distilled water, ion exchanged water or the like, or may be treated with an ion exchange resin, for removing the influence of the residual catalyst after synthesis or procurement of a commercially available product.

The particular charge transporting material will be described. Examples of the particular charge transporting material include a compound having at least one substituent selected from —OH, —$OCH_3$, —$NH_2$, —SH and —COOH. Preferred examples of the particular charge transporting material include a compound having at least two (more preferably three) substituents selected from —OH, —$OCH_3$, —$NH_2$, —SH and —COOH. When the number of the reactive functional group (i.e., the substituent) of the particular charge transporting material is increased, the crosslinking density is increased to provide a crosslinked film having a larger strength, and thus the rotation torque of the electrophotographic photoreceptor body upon using a foreign matter removing member, such as a blade member, is decreased, thereby suppressing the foreign matter removing member and the electrophotographic photoreceptor body from being abraded. While the factors of the advantage are not completely clear, it is considered that the cured film having a large crosslinking density provided by increasing the number of the reactive functional group suppresses the molecular motion on the extreme surface of the electrophotographic photoreceptor body, and thus the mutual action with respect to the surface molecules of the blade member is decreased.

The particular charge transporting material may be a compound represented by the following general formula (I) from the standpoint of prevention of abrasion of the foreign matter removing member and abrasion of the electrophotographic photoreceptor body.

$$F—((—R^{13}—X)_{n1}(R^{14})_{n2}—Y)_{n3} \quad (I)$$

In the general formula (I), F represents an organic group derived from a compound having a hole transporting function, $R^{13}$ and $R^{14}$ each independently represent a linear or branched alkyl group having from 1 to 5 carbon atoms, n1 represents 0 or 1, n2 represents 0 or 1, n3 represents an integer of from 1 to 4, X represents oxygen, NH or sulfur, and Y represents —OH, —$OCH_3$, —$NH_2$, —SH or —COOH.

Examples of the compound having a hole transporting property in the organic group derived from a compound having a hole transporting property represented by F include an arylamine derivative. Examples of the arylamine derivative include a triphenylamine derivative and a tetraphenylbenzidine derivative.

The compound represented by the general formula (I) may be a compound represented by the following general formula (II). The compound represented by the general formula (II) is excellent particularly in charge mobility, stability to an acid or the like, and the like.

(II)

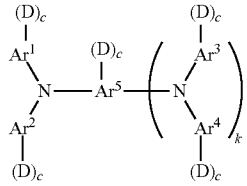

In the general formula (II), $Ar^1$ to $Ar^4$ may be the same as or different from each other and each independently represent a substituted or unsubstituted aryl group, $Ar^5$ represents a substituted or unsubstituted aryl group or a substituted or unsubstituted arylene group, D represents —(—$R^{13}$—X)$_{n1}$($R^{14}$)$_{n2}$—Y, c independently represents 0 or 1, and k represents 0 or 1, provided that the total number of the group represented by D is from 1 to 4. $R^{13}$ and $R^{14}$ each independently represent a linear or branched alkylene group having from 1 to 5 carbon atoms, n1 represent 0 or 1, n2 represents 0 or 1, X represents oxygen, NH or sulfur, and Y represents —OH, —$OCH_3$, —$NH_2$, —SH and —COOH.

The group —(—$R^{13}$—X)$_{n1}$($R^{14}$)$_{n2}$—Y represented by D is the same as in the general formula (I), in which $R^{13}$ and $R^{14}$ each independently represent a linear or branched alkylene group having from 1 to 5 carbon atoms. n1 is preferably 1. n2 is preferably 1. X is preferably oxygen. Y is preferably a hydroxyl group.

The total number of the group represented by D corresponds to n3 in the general formula (I) and may preferably be from 2 to 4, and more preferably from 3 to 4.

When the total number of D per one molecule is from 2 to 4, and preferably from 3 to 4, in the general formulae (I) and (II), the crosslinking density is increased to provide a crosslinked film having a larger strength, and thus the rotation torque of the electrophotographic photoreceptor body upon using a blade member as a foreign matter removing member, is decreased, thereby suppressing the blade member and the electrophotographic photoreceptor body from being abraded. While the factors of the advantage are not completely clear, it is considered that, as having been described above, the cured film having a large crosslinking density provided by increasing the number of the reactive functional group suppresses the molecular movement on the extreme surface of the electrophotographic photoreceptor body, and thus the mutual action with respect to the surface molecules of the blade member is decreased.

In the general formula (II), $Ar^1$ to $Ar^4$ may each be one of groups represented by the following formulae (1) to (7). The formulae (1) to (7) are each shown with $-(D)_c$ bonded to each of $Ar^1$ to $Ar^4$.

(1)

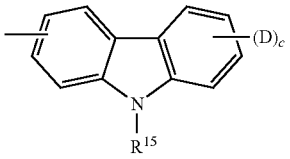

(2)

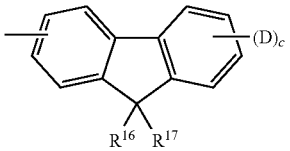

(3)

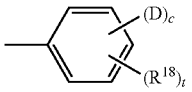

(4)

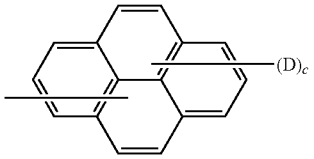

(5)

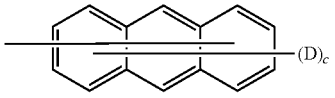

(6)

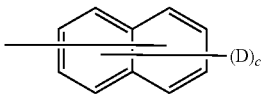

(7)

$$-Ar-(Z')_s-Ar-(D)_c$$

In the formulae (1) to (7), $R^{15}$ represents one selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, and an aralkyl group having from 7 to 10 carbon atoms, $R^{16}$ to $R^{18}$ each represent one selected from a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, Ar represents a substituted or unsubstituted arylene group, D and c have the same meanings as D and c in the general formula (II), s represents 0 or 1, and t represents an integer of from 1 to 3.

Examples of Ar in the formula (7) include groups represented by the following formulae (8) and (9).

(8)

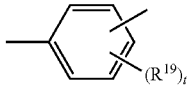

(9)

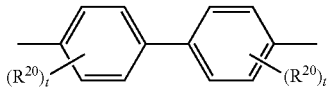

In the formulae (8) and (9), $R^{19}$ and $R^{20}$ each represents one selected from the group consisting of an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, and t represents an integer of from 1 to 3.

In the formula (7), examples of the group represented by Z' include groups represented by the following formulae (10) to (17).

(10)

$$-(CH_2)_q-$$

(11)

$$-(CH_2CH_2O)_r-$$

(12)

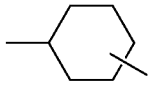

(13)

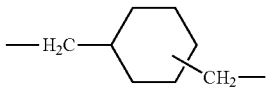

(14)

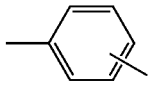

(15)

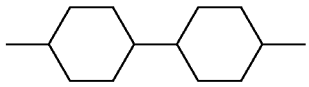

-continued (16)

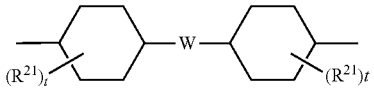

(17)

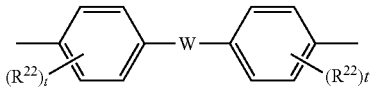

In the formulae (10) to (17), $R^{21}$ and $R^{22}$ each represents one selected from the group consisting of an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, W represents a divalent group, q and r each represents an integer of from 1 to 10, and t represents an integer of from 1 to 3.

In the formulae (16) and (17), the group represented by W may be one of divalent groups represented by the following formulae (18) to (26). In the formula (25), u represents an integer of from 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

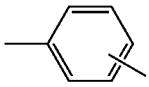

(25)

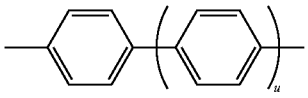

(26)

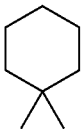

In the general formula (II), when k is 0, $Ar^5$ is the aryl groups represented by the formulae (1) to (7) exemplified for $Ar^1$ to $Ar^4$, and when k is 1, $Ar^5$ is the arylene groups obtained by removing a hydrogen atom from the aryl groups represented by the formulae (1) to (7).

Specific examples of the compound represented by the general formula (I) include the following compounds, but the compound represented by the general formula (I) is not limited to the exemplary compound.

I-1

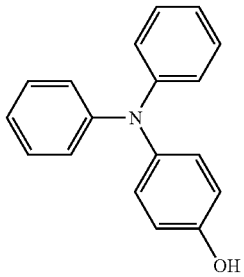

I-2

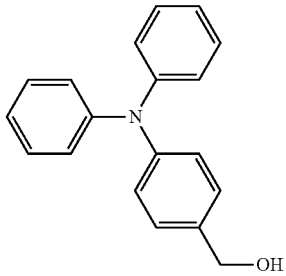

I-3

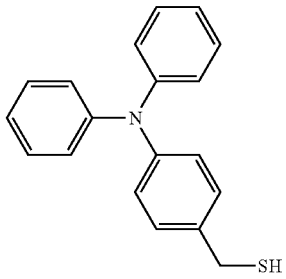

I-4

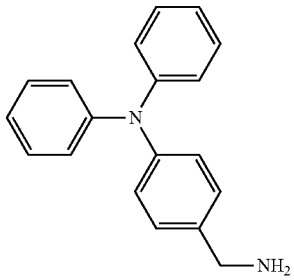

I-5

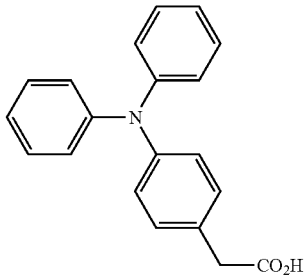

-continued
I-6
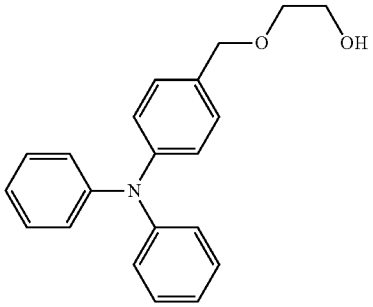
I-7
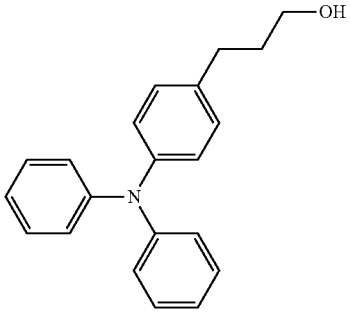
I-8
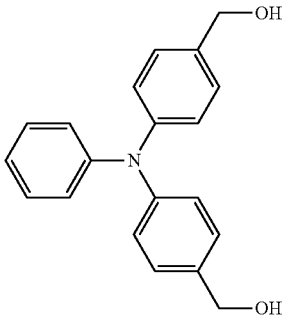
I-9
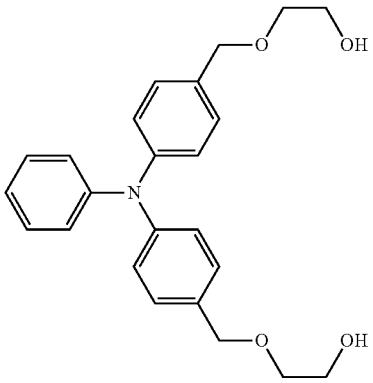
-continued
I-10
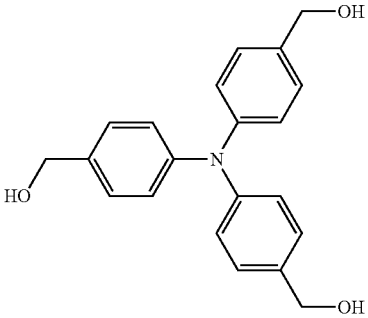
I-11
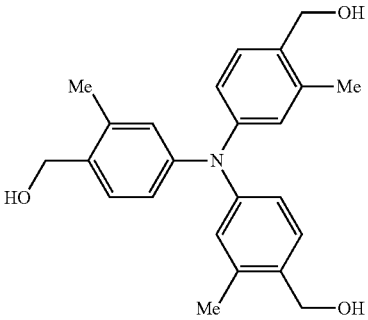
I-12
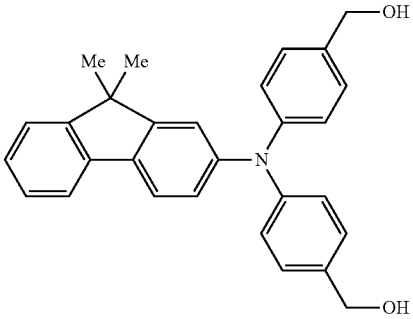
I-13
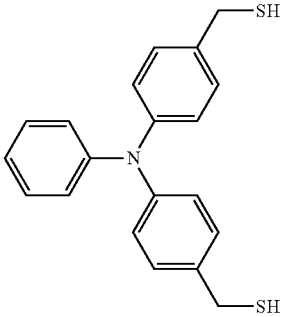
I-14
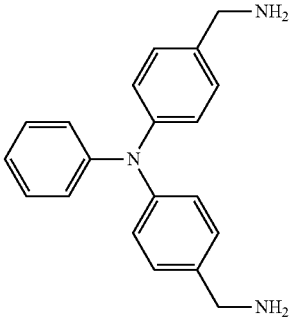

-continued
I-15
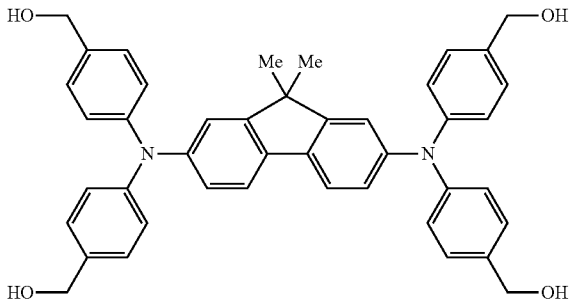
I-16
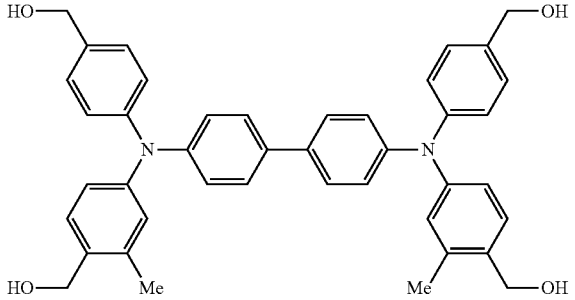
I-17
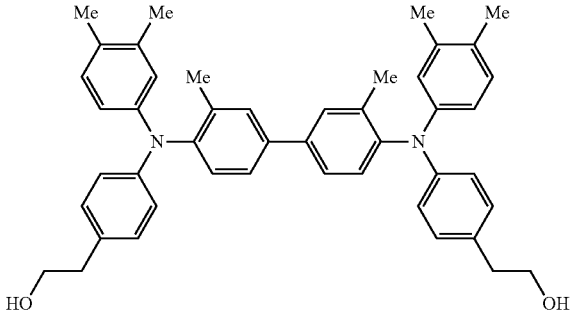
I-18
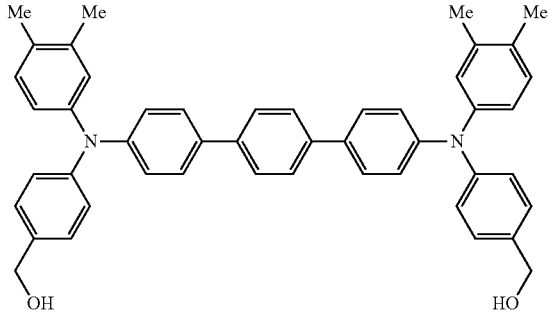
I-19
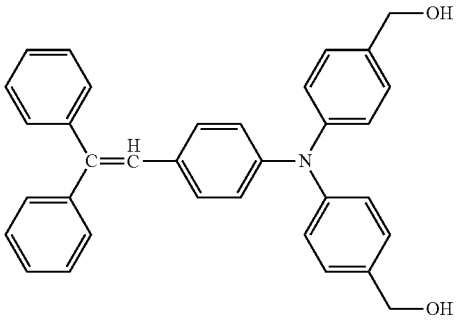
-continued
I-20
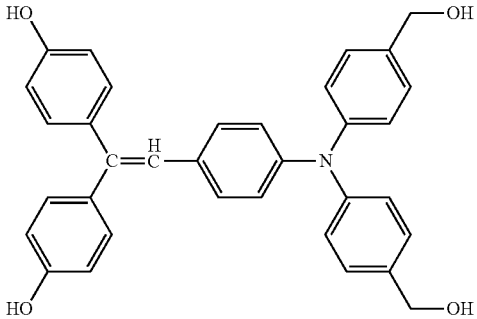
I-21
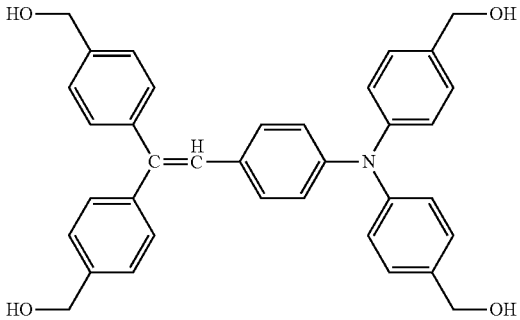
I-22
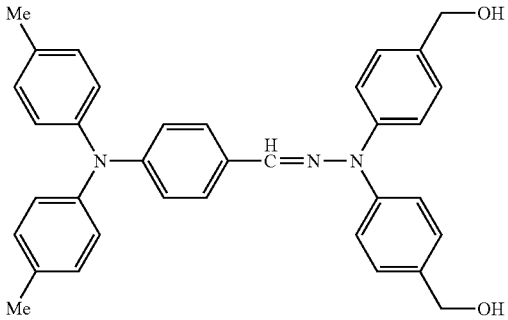
I-23
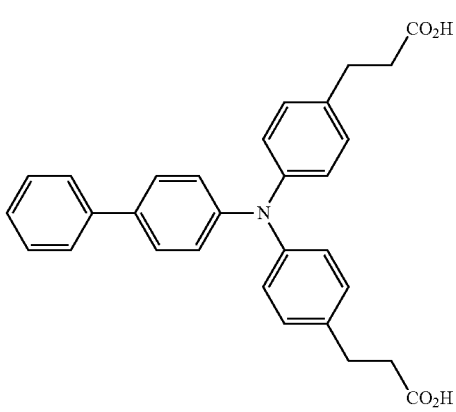

-continued
I-24
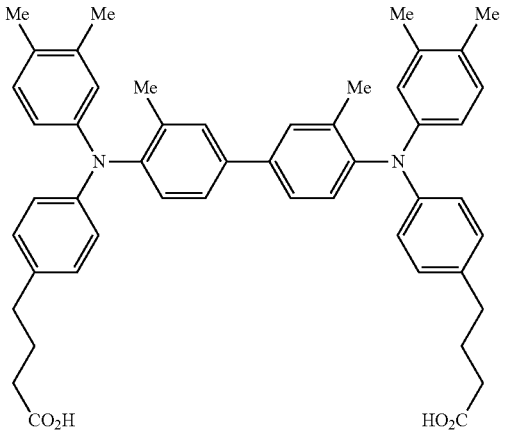
I-25
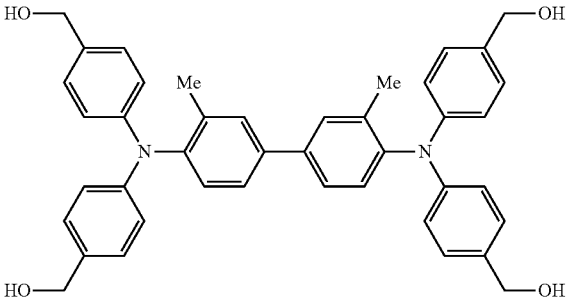
I-26
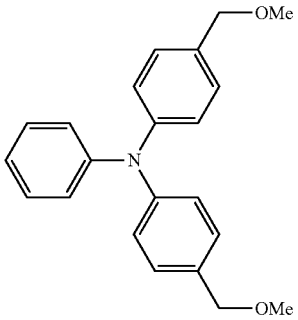
I-27
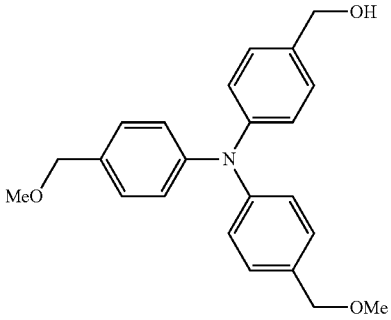
-continued
I-28
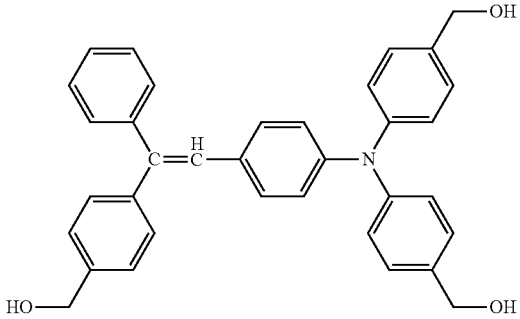
I-29
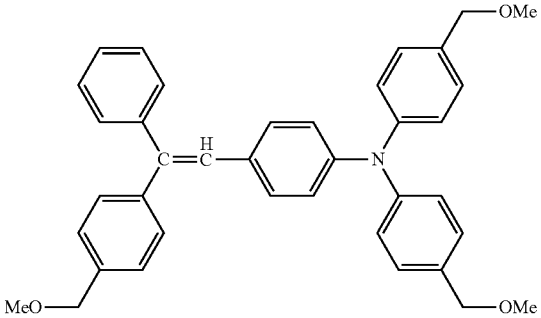
I-30
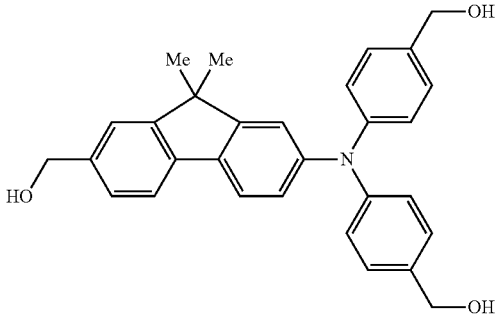
I-31
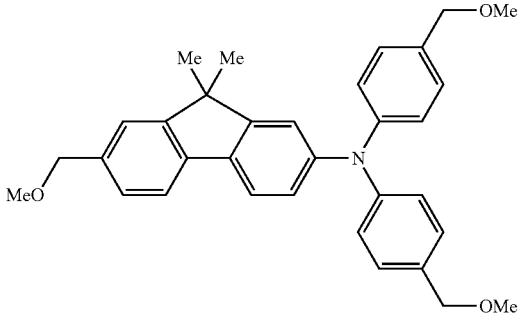

-continued

I-32

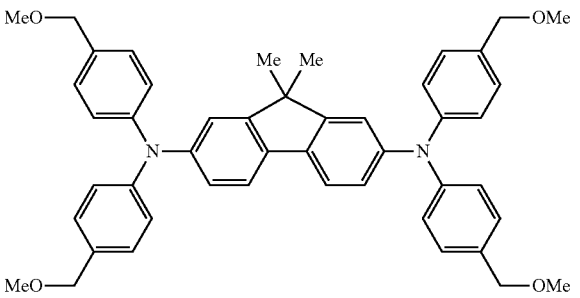

I-33

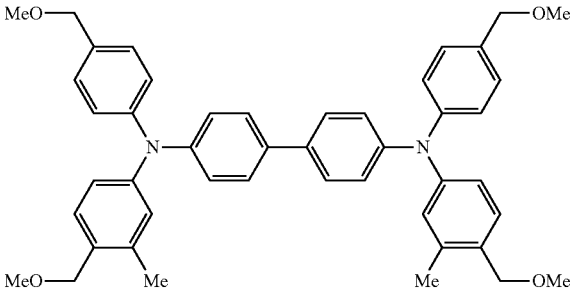

I-34

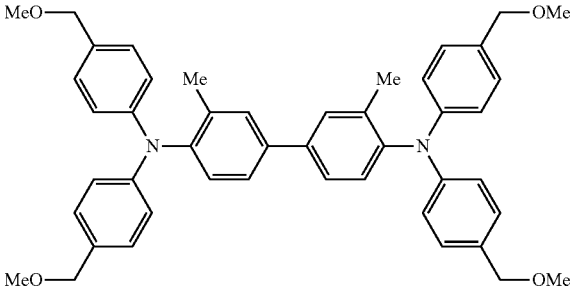

The content of at least one selected from the guanamine compound (i.e., the compound represented by the general formula (A)) and the melamine compound (i.e., the compound represented by the general formula (B)) (which is the solid concentration in the coating composition) may be from approximately 0.1 to approximately 5% by mass, and preferably from approximately 1 to approximately 3% by mass. When the solid concentration is less than approximately 0.1% by mass, a dense film may not be obtained to fail to provide sufficient strength, and when the solid content exceeds approximately 5% by mass, the electric characteristics and the ghost resistance (density unevenness in image history) may be deteriorated.

The content of at least one of the particular charge transporting material (which is the solid concentration in the coating composition) may be approximately 90% by mass or more, and preferably approximately 94% by mass or more. When the solid content is less than approximately 90% by mass, the electric characteristics may be deteriorated. The upper limit of the solid content is not particularly limited as far as the guanamine compound (i.e., the compound represented by the general formula (A)), the melamine compound (i.e., the compound represented by the general formula (B)) and the other additives effectively function, and may be as large as possible.

The surface protective layer will be described in more detail below.

The surface protective layer may contain, along with the crosslinked product of at least one selected from the guanamine compound (i.e., the compound represented by the general formula (A)) and the melamine compound (i.e., the compound represented by the general formula (B)), and the particular charge transporting material (i.e., the compound represented by the general formula (I)), a phenol resin, a urea resin, an alkyd resin and the like mixed therein. For enhancing the strength, it is effective to copolymerize a compound having a larger number of functional groups per one molecule, such as "CTU-Guanamine, available from Ajinomoto Fine-Techno Co., Inc., with the materials in the crosslinked product.

The surface protective layer may contain another thermosetting resin, such as a phenol resin, mixed therein for preventing excessive absorption of discharge-generating gas, thereby preventing efficiently oxidation due to the discharge-generating gas.

The surface protective layer may contain a surfactant. The surfactant used is not particularly limited as far as it is a surfactant having at least one structure selected from a fluorine atom, an alkylene oxide structure and a silicone structure. A surfactant having a plurality of the aforementioned structures may be used since the surfactant has high affinity and compatibility with the charge transporting organic compound, whereby the film forming property of the coating composition for forming the surface protective layer is enhanced to suppress the surface protective layer from suffering wrinkles and unevenness.

The surface protective layer may contain a coupling agent and a fluorine compound for controlling the film forming property, the flexibility, the lubricating property and the adhesiveness of the film. Examples of the compounds used include various kinds of silane coupling agents and commercially available silicone hardcoat agents.

The surface protective layer may contain an alcohol soluble resin for controlling the discharge gas resistance, mechanical strength, scratch resistance, particle dispersibility, and viscosity, reduction of the torque, controlling the abrasion amount and extension of the pot-life of the surface protective layer.

The alcohol soluble resin herein may be a resin that is soluble in an alcohol having 5 or less carbon atoms in an amount of 1% by mass or more. Examples of the alcohol soluble resin include a polyvinyl acetal resin and polyvinyl phenol resin.

The surface protective layer may contain an antioxidant for preventing deterioration due to an oxidizing gas, such as ozone, generated in the charging device. When the mechanical strength of the surface of the electrophotographic photoreceptor body is increased to enhance the long-life of the electrophotographic photoreceptor body, the electrophotographic photoreceptor is exposed to an oxidizing gas for a prolonged period of time, and thus larger oxidation resistance is demanded. The antioxidant may be a hindered phenol antioxidant or a hindered amine antioxidant, and known antioxidants, such as an organic sulfur antioxidant, a phosphite antioxidant, a dithiocarbamate salt antioxidant, a thiourea antioxidant and a benzimidazole antioxidant, may also be used. The amount of the antioxidant added may be approximately 20% by mass or less, and preferably approximately 10% by mass or less.

The surface protective layer may contain various kinds of particles for decreasing the residual potential and for enhancing the strength. Examples of the particles include silicon-containing particles. The silicon-containing particles are particles containing silicon as a constitutional element, and specific examples thereof include colloidal silica and silicone particles.

An oil, such as a silicone oil, may be added to the surface protective layer for the similar purposes.

The surface protective layer may contain a metal, a metal oxide, carbon black and the like.

The surface protective layer may be a cured film obtained by curing at least one selected from a guanamine compound and a melamine compound, and the particular charge transporting material, with an acid catalyst. Examples of the acid catalyst include an aliphatic carboxylic acid, such as acetic acid, chloroacetic acid, trichloroacetic acid, trifluoroacetic acid, oxalic acid, maleic acid, malonic acid and lactic acid, an aromatic carboxylic acid, such as benzoic acid, phthalic acid, terephthalic acid and trimellitic acid, and an aliphatic or aromatic sulfonic acid, such as methanesulfonic acid, dodecylsulfonic acid, benzenesulfonic acid, dodecylbenzenesulfonic acid and naphthalenesulfonic acid, and a sulfur-containing material may be preferably used.

The amount of the catalyst mixed may be in a range of from approximately 0.1 to approximately 50% by mass, and preferably from approximately 10 to approximately 30% by mass, based on the amount of at least one selected from the guanamine compound (i.e., the compound represented by the general formula (A)) and the melamine compound (i.e., the compound represented by the general formula (B)) (which is the solid concentration in the coating composition). When the amount is lower than the range, the catalyst activity may be too low, and when the amount exceeds the range, the light resistance may be deteriorated. The light resistance herein refers to such a phenomenon that upon irradiating a photosensitive layer with external light, such as room light, the irradiated portion is decreased in image density. While the factor of the phenomenon is not completely clear, it is considered that a phenomenon similar to the optoelectronic memory effect may occur, as described in JP-A-5-099737.

The surface protective layer having the aforementioned constitution may be formed by using a coating composition for forming a surface protective layer containing the aforementioned components. The coating composition for forming a surface protective layer may be prepared without a solvent or may be prepared by using a solvent depending on necessity. The solvent may be used solely or as a mixture of two or more thereof, and a solvent having a boiling point of 100° C. or less may be used. A solvent having at lease one hydroxyl group (such as an alcohol) may be used therefor.

Upon forming the coating composition through reaction of the aforementioned components, the components may be simply mixed and dissolved, and may be mixed and dissolved under heating to a temperature of from room temperature (approximately 25° C.) to approximately 100° C., and preferably from approximately 30° C. to approximately 80° C., for a period of from approximately 10 minutes to approximately 100 hours, and preferably from approximately 1 hour to approximately 50 hours. The components may be mixed under application of an ultrasonic wave, whereby the reaction may proceed locally to facilitate a film with less coating defect and less fluctuation in thickness.

The coating composition for forming a surface protective layer may be then coated by a known method, such as a blade coating method, a Meyer bar coating method, a spray coating method, a dip coating method, a bead coating method, a air knife coating method and a curtain coating method, and cured under heating depending on necessity to a temperature of from approximately 100° C. to approximately 170° C., thereby providing the surface protective layer.

The function-separated electrophotographic photoreceptor has been described as an example, but in the case where a single layer photosensitive layer (i.e., a charge generating/transporting layer) shown in FIG. 6 is produced, the content of the charge generating material may be from approximately 10 to approximately 85% by mass, and preferably from approximately 20 to approximately 50% by mass. The content of the charge transporting material may be approximately 5 to approximately 50% by mass.

As the production method of the single layer photosensitive layer, a production method that is similar to the production method of the charge generating layer and the charge transporting layer may be employed. The thickness of the single layer photosensitive layer may be from approximately 5 μm to approximately 50 μm, and preferably from approximately 10 μm to approximately 40 μm.

Image Forming Apparatus, Process Cartridge

Figure 7:
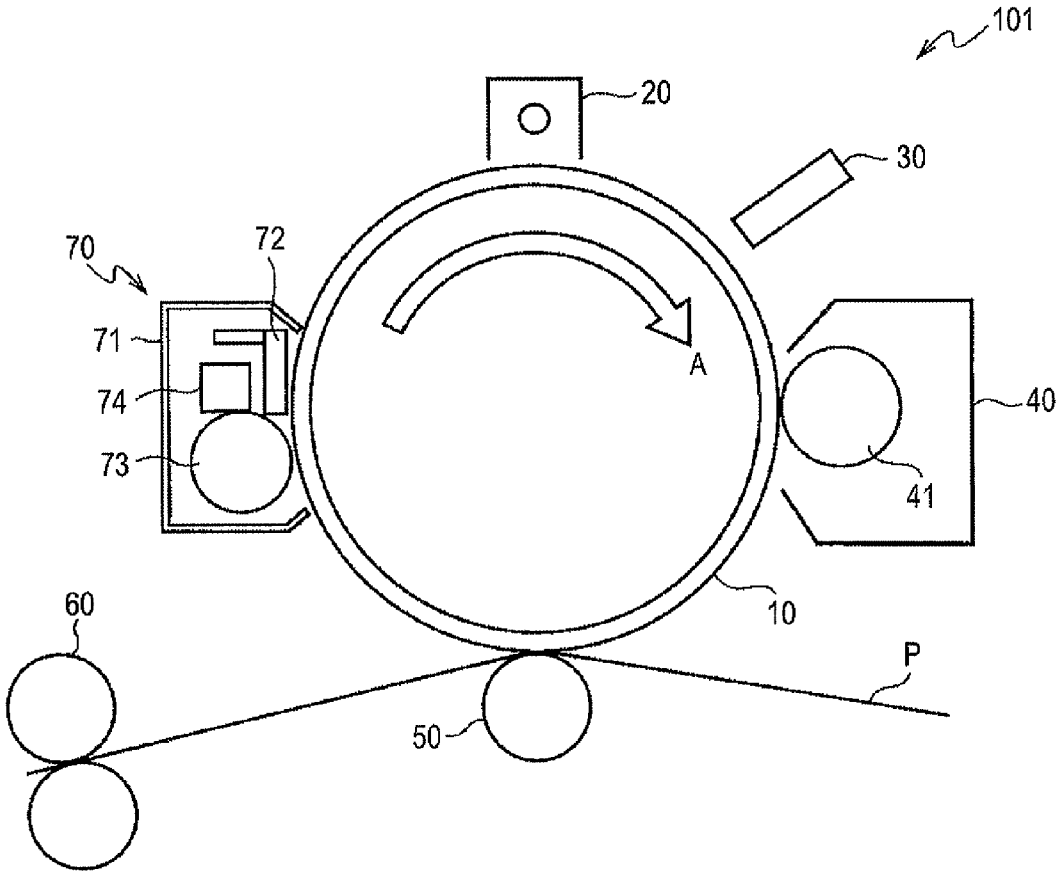
FIG. 7 is a schematic structural view showing an example of an image forming apparatus according to an exemplary embodiment.

FIG. 7 is a schematic structural view showing an example of an image forming apparatus according to the exemplary embodiment.

The image forming apparatus 101 according to the exemplary embodiment has, for example, as shown in FIG. 7, an electrophotographic photoreceptor 10 that is rotated clockwise as shown by the arrow A; a charging device 20 (as an example of a charging unit) that charges the surface of the electrophotographic photoreceptor 10, and is disposed above the electrophotographic photoreceptor 10 to face the electrophotographic photoreceptor 10; an exposing device 30 (as an example of an electrostatic latent image forming unit) that exposes the surface of the electrophotographic photoreceptor 10, which is charged with the charging device 20, to form an electrostatic latent image; a developing device 40 (as an example of a developing unit) that attaches a toner contained in a developer to the electrostatic latent image, which is formed with the exposing device 30, to form a toner image on the surface of the electrophotographic photoreceptor 10; a transferring device 50 that charges recording paper P (as an example of a transfer medium) to a polarity that is reverse to the charging polarity of the toner, thereby transferring the toner image on the electrophotographic photoreceptor 10 to the recording paper P; and a cleaning device 70 (as an example of a toner removing unit) that cleans the surface of the electrophotographic photoreceptor 10. The image forming apparatus 101 further has a fixing device 60 that fixes the toner image while conveying the recording paper P having the toner image formed thereon.

The major constitutional components of the image forming apparatus 101 of the exemplary embodiment will be described.

Charging Device

Examples of the charging device 20 include a contact charging device using an electroconductive member, such as a charging roller, a charging brush, a charging film, a charging rubber blade and a charging tube. Examples of the charging device 20 also include a non-contact charging device, such as a non-contact roller charging device, and a known charging device, such as a scorotron charging device and a corotron charging device utilizing corona discharge. The charging device 20 may be a contact charging device.

Exposing Device

Examples of the exposing device 30 include an optical device that imagewise exposes the surface of the electrophotographic photoreceptor 10 with light, such as semiconductor laser light, LDE light and liquid crystal shutter light. The light source may have a wavelength that is within the spectral sensitivity range of the electrophotographic photoreceptor 10. The wavelength of a semiconductor laser may be, for example, an oscillation wavelength in the near infrared region around 780 nm. The wavelength is not limited thereto, and a laser having an oscillation wavelength in the order of 600 nm, and a blue laser having an oscillation wavelength of from 400 nm to 450 nm may be employed. The exposing device 30 may be, for example, a plane emission laser light source that outputs multiple laser beam for forming a color image.

Developing Device

Examples of the developing device 40 include on having such a structure that has a developing roll 41 disposed to face the electrophotographic photoreceptor 10 in the developing area within a vessel housing a two-component developer containing a toner and a carrier. The developing device 40 may be a developing device using a single-component developer containing a toner or may be a developing device using a two-component developer containing a toner and a carrier, which may have known constitutions.

Transferring Device

Examples of the transferring device 50 include a contact transferring charging device using a belt, a roller, a film, a rubber blade or the like, and a known transferring charging device, such as a scorotron transferring charging device and a corotron transferring charging device utilizing corona discharge.

Cleaning Device

Examples of the cleaning device 70 include a cleaning device having a housing 71, a cleaning blade 72, and a cleaning brush 73 disposed on the downstream side of the cleaning blade in the rotation direction of the electrophotographic photoreceptor 10. A solid lubricant 74 may be disposed in contact with the cleaning brush 73.

An operation of the image forming apparatus 101 of the exemplary embodiment will be described below. The electrophotographic photoreceptor 10 is rotated in the direction shown by the arrow a, and simultaneously charged negatively with the charging device 20.

The electrophotographic photoreceptor 10 having a surface that has been negatively charged with the charging device 20 is exposed imagewise with the exposing device to form a latent image on the surface thereof.

When the portion of the electrophotographic photoreceptor 10 having the latent image formed thereon gets close to the developing device 40, a toner is attached to the latent image with the developing device 40 (i.e., the developing roll 41), thereby forming a toner image.

The electrophotographic photoreceptor 10 having the toner image formed thereon is further rotated in the direction shown by the arrow a, and the toner image is transferred to recording paper P with the transferring device 50. Consequently, a toner image formed on the recording paper P.

The recording paper P having an image formed thereon is subjected to fixing where the toner image is fixed with the fixing device 60.

Figure 8:
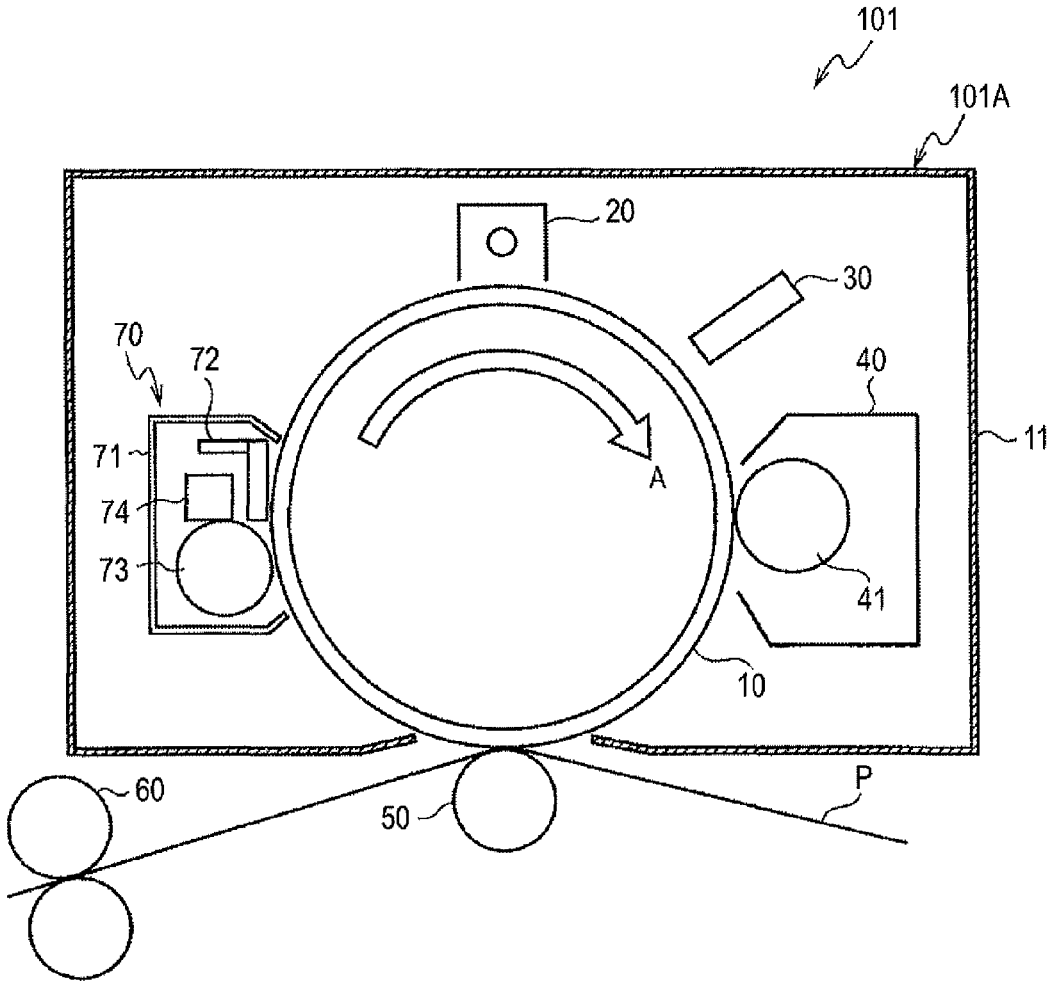
FIG. 8 is a schematic structural view showing another example of an image forming apparatus according to an exemplary embodiment.

The image forming apparatus 101 of the exemplary embodiment may have, for example, as shown in FIG. 8, a process cartridge 101A having an electroconductive photoreceptor 10, a charging device 20, an exposing device 30, a developing device 40 and a cleaning device 70, which are integrated and housed in a housing 11. The process cartridge 101A houses plural members integrally, and is detached from and attached to the image forming apparatus 101.

The structure of the process cartridge 101A is not limited thereto, and the process cartridge may have at least an electrophotographic photoreceptor 10, and may have at least one selected from a charging device 20, an exposing device 30, a developing device 40, a transferring device 50 and a cleaning device 70.

The image forming apparatus 101 of the exemplary embodiment is not limited to the aforementioned structure, and may have, for example, such a structure that a first erasing device for arranging the polarity of the remaining toner to facilitate removal of the toner with the cleaning brush is disposed on the downstream side with respect to the transferring device 50 in the rotation direction of the electrophotographic photoreceptor 10 and on the upstream side of the cleaning device 70 in the rotation direction of the electrophotographic photoreceptor 10, or such a structure that a second erasing device for erasing the surface charge of the electrophotographic photoreceptor 10 is disposed on the downstream side of the cleaning device 70 in the rotation direction of the electrophotographic photoreceptor 10 and on the upstream side with respect to the charging device 20 in the rotation direction of the electrophotographic photoreceptor 10.

The image forming apparatus 101 of the exemplary embodiment is not limited to the aforementioned structure, and may have, for example, a known structure, such as an intermediate transferring image forming apparatus, in which a toner image formed on an electrophotographic photoreceptor 10 is transferred to an intermediate transfer medium, and then further transferred to recording paper P, and may be a tandem image forming apparatus.

EXAMPLES

The invention will be describe with reference to examples and comparative examples below, but the invention is not construed as being limited to the examples.

Production of Electrophotographic Photoreceptor

Electrophotographic Photoreceptor (1)

Preparation of Electroconductive Substrate

A cylindrical aluminum substrate as a cylindrical electroconductive substrate is produced in the following manner.

An Al—Mg series aluminum alloy (alloy according to JIS A5056) is formed into an element tube by drawing.

Socket joint portions are formed on the inner surfaces at the end portions in the axial direction (the inner surface from the end to 10 mm inside in the axial direction) of the element tube with a precision NC lathe.

The outer surface of the element tube having the socket joint portions is subjected to a cutting process.

According to the aforementioned manner, an aluminum substrate (i.e., an electroconductive substrate) having an outer diameter of 84 mm, an entire length of 340 mm, a thickness of the other portion than the socket joint portion of 2.0 mm, a thickness of the socket joint portion of 1.75 mm, and a diameter of the opening of 80.50 mm is produced.

Production of Electrophotographic Photoreceptor Body

An electrophotographic photoreceptor body is produced in the following manner.

100 parts by mass of zinc oxide (average particle diameter: 70 nm, specific surface area: 15 $m^2/g$, available from Tayca Corporation) is mixed with 500 parts by mass of toluene by stirring, to which 1.3 parts by mass of a silane coupling agent (KBM503, available from Shin-Etsu Chemical Co., Ltd.) is added, followed by stirring for 2 hours. Thereafter, toluene is distilled off by distillation under reduced pressure, and the residue is baked at 120° C. for 3 hours to provide zinc oxide surface-treated with the silane coupling agent.

110 parts by mass of the surface-treated zinc oxide is mixed with 500 parts by mass of tetrahydrofuran by mixing, to which a solution containing 0.6 part by mass of alizarine dissolved in 50 parts by mass of tetrahydrofuran is added, followed by stirring at 50° C. for 5 hours. Thereafter, the zinc oxide attached with alizarine is filtered by filtering under reduced pressure, and dried at 60° C. under reduced pressure, thereby providing alizarine-attached zinc oxide.

60 parts by mass of the alizarine-attached zinc oxide, 38 parts by mass of a solution containing 13.5 parts by mass of curing agent (blocked isocyanate, Sumidur 3175, available from Sumitomo Bayer Urethane Co., Ltd.) and 15 parts by mass of a butyral resin (S-Lec BM-1, available from Sekisui Chemical Co., Ltd.) dissolved in 85 parts by mass of methyl ethyl ketone, and 25 parts by mass of methyl ethyl ketone are mixed and dispersed with a sand mill using glass beads having a diameter of 1 mm for 2 hours, thereby providing a dispersion liquid.

0.005 part by mass of dioctyltin dilaurate as a catalyst and 45 parts by mass of silicone resin particles (Tospearl 145, available from GE Toshiba Silicone Co., Ltd.) are added to the resulting dispersion liquid, thereby providing a coating composition for an underlayer. The coating composition is coated on the aluminum substrate by a dip coating method and dried and cured at 190° C. for 40 minutes, thereby providing an underlayer having a thickness of 18 μm.

1 part by mass of chlorogallium phthalocyanine having distinct diffraction peaks at Bragg angles (2θ±0.2°) of 7.4°, 16.6°, 25.5° and 28.3° in an X-ray diffraction spectrum, 1 part by mass of polyvinyl butyral (S-Lec BM-1, available from Sekisui Chemical Co., Ltd.) and 100 parts by mass of n-butyl acetate are mixed and processed in a paint shaker along with glass beads for 1 hour, thereby providing a coating composition for forming a charge generating layer. The coating composition is coated on the underlayer by a dip coating method and dried and cured at 100° C. for 10 minutes, thereby providing a charge generating layer having a thickness of 0.10 μm.

42 parts by mass of a charge transporting material represented by the following formula (CT-1) and 58 parts by mass of a bisphenol Z polycarbonate resin (Z800, available from Mitsubishi Gas Chemical Co., Inc.) are sufficiently dissolved and mixed with 280 parts by mass of tetrahydrofuran and 120 parts by mass of toluene, thereby providing a coating composition. The coating composition is coated on the charge generating layer and dried at 135° C. for 40 minutes, thereby providing a charge transporting layer having a thickness of 23 μm.

Thus, an electrophotographic photoreceptor body (1) is produced.

(CT-1)

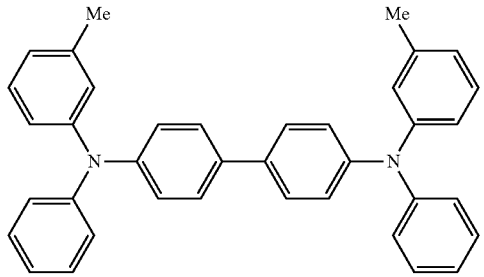

Electrophotographic Photoreceptor Body (2)

0.09 part by mass of a guanamine resin (Nikarak MW-30, available from Nippon Carbide Industries, Co., Inc.), 99 parts by mass of the exemplary compound (I-30) as the charge transporting material and 0.15 part by mass of p-toluenesulfonic acid as an acid catalyst are dissolved in cyclopentanol, thereby providing a coating composition for forming a protective layer.

The resulting coating composition for forming a protective layer is coated on the electrophotographic photoreceptor body (1) (i.e., on the charge transporting layer thereof) and dried in the air at room temperature for 30 minutes. Thereafter, the coated layer is heat-treated at 145° C. for 1 hour, thereby providing a surface protective layer having a thickness of 8.0 μm.

Thus, an electrophotographic photoreceptor body (2) is produced.

Production of Flange

Flange (1)

A resin composition containing a resin (glass fiber-containing resin, Panlite, available from Teijin Chemicals, Ltd.) and 30% by mass of glass fibers is injection-molded to produce a flange (1) having an outer diameter of the flange body of 84.00 mm, an outer diameter of the fitting portion (fitting portion body) of 80.490 mm and an arithmetic average roughness Ra of the surface of the fitting portion (fitting portion body) of 0.75 μm (see FIGS. 2 and 3).

Flanges (2) to (15)

Flanges (2) to (15) are produced in the same manners as the flange (1) except that the outer diameter of the flange body, the outer diameter of the fitting portion (fitting portion body) and the content of glass fibers are changed, and the arithmetic average roughness Ra of the surface of the fitting portion is changed by surface processing depending on necessity, according to Table 1 (see FIGS. 2 and 3).

Examples 1 to 13 and Comparative Examples 1 to 4

The electrophotographic photoreceptor bodies and the flanges thus produced are combined according to Table 2 by fitting the fitting portion of the flange into the opening at the end in the axial direction of the electroconductive substrate of the electrophotographic photoreceptor body, thereby providing electrophotographic photoreceptors.

Evaluation

The resulting electrophotographic photoreceptors are evaluated in the following manners. The results are shown in Table 2.

Total Runout

The electrophotographic photoreceptor is measured and evaluated for total runout in the following manner.

Figure 9:
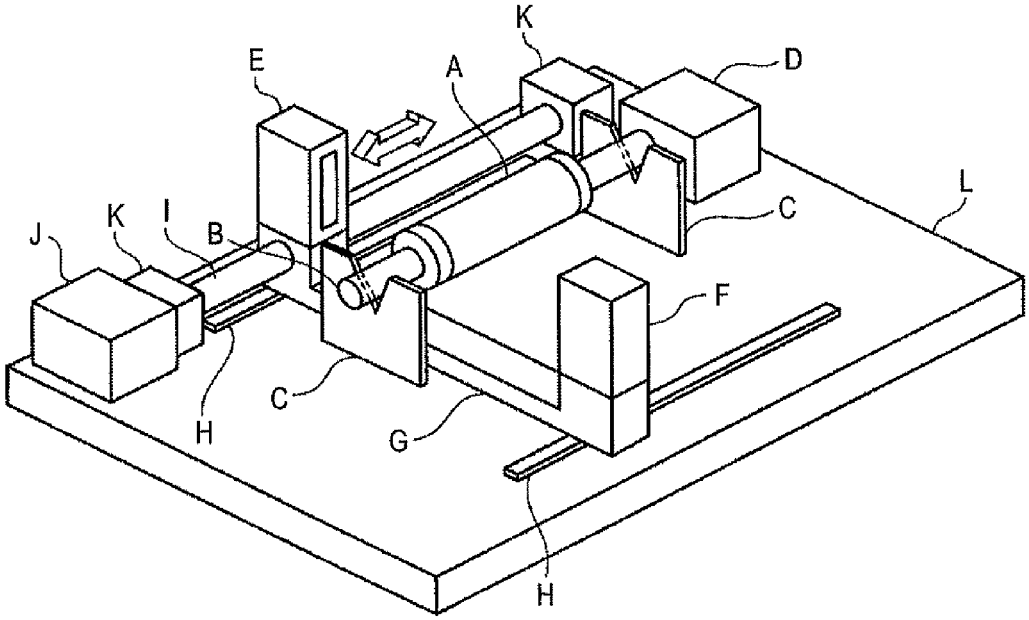
FIG. 9 is a schematic structural view showing an example of a total runout measuring apparatus for measuring a total runout of an electrophotographic photoreceptor.

The total runout is measured by using an apparatus shown in FIG. 9. As shown in FIG. 9, the shaft B (i.e., the shaft of the flange) of the electrophotographic photoreceptor A as an object to be measured is aligned and placed gently on V blocks C. The shaft B of the electrophotographic photoreceptor A is connected to a rotation device D, with which the electrophotographic photoreceptor A is rotated. The rotation number of the electrophotographic photoreceptor A is controlled to a suitable rotation number with a drive controller (which is not shown in the figure). The rotation number used is 3 rpm.

A transmission laser sensor, LS-3100, available from Keyence Corporation, is used as a sensor for measuring runout, and the runout in the radial direction is sampled at the laser emission part E and the laser receiving part F while rotating the electrophotographic photoreceptor A. The output signal is output as an electric signal through an exclusive line (which is not shown in the figure) and input to an operational device (which is not shown in the figure). The sampling number per one revolution of the electrophotographic photoreceptor A may be arbitrarily determined by the operational device, and the runout is measured at 30 positions.

The laser emission part E and the laser receiving part F are placed on a pedestal G, and the pedestal G is fixed to a platen L through a linear guide H. The laser emission part E and the laser receiving part F are moved reciprocally in the axial direction of the electrophotographic photoreceptor A (i.e., the direction shown by the arrow in the figure) along with the pedestal G connected to a ball screw I, which is supported by the ball screw retainer K, by rotating the ball screw I with a driving device J. The driving device J is switched between on state and off state with a driving controller (which is not shown in the figure) and makes the laser emission part E and the laser receiving part F to stop at an arbitrary position in the axial direction. The laser emission part E and the laser receiving part F are moved and stopped at 9 positions in the axial direction, and the runout is measured at each of the 9 positions.

The runout measured in the aforementioned manner is input to a data processor (98 Note SX/E, available from NEC Corporation) through an RS232C cable and operated for providing a total runout.

Unevenness in Image Density

The resulting electrophotographic photoreceptor is mounted on an image forming apparatus (DocuCentre 1257GA, available from Fuji Xerox Co., Ltd.). A black halftone image (image density: 45%) is output with A3 paper (C2 Paper, available from Fuji Xerox Co., Ltd.) under the general environment (22° C., 50% RH), and the output image is evaluated for unevenness in image density (evaluation of initial unevenness in image density).

After outputting an image with an area coverage (proportion of image area per one image) of 5% for 400,000 sheets under the same environment, a halftone image (image density: 45%) is output with A3 paper, and the output image is evaluated for unevenness in image density (evaluation of long-term unevenness in image density).

The unevenness in image density is evaluated in the following standard.

AA: no unevenness in image density found with no problem in use for high image quality A: slight unevenness in image density found with no problem in practical use B: unevenness in image density found with problem in use C: unevenness in image density found overall, not suitable for practical use Abrasion Amount of Outermost Layer of Electrophotographic Photoreceptor The abrasion amount of the outermost layer of the electrophotographic photoreceptor (i.e., the abrasion amount per 1,000 rotations of the electrophotographic photoreceptor) is measured in the following manner. The outermost layer of the electrophotographic photoreceptor is measured for thickness before and after the test for unevenness in image density, and the abrasion amount after printing 400,000 sheets is obtained from the difference between the thicknesses. The abrasion amount per 1,000 rotation of the electrophotographic photoreceptor is calculated from the abrasion amount after printing 400,000 sheets and the rotation number of the photoreceptor.

TABLE 1

| | Outer diameter of flange body (mm) | Outer diameter of fitting portion (fitting portion body) (mm) | Difference between outer diameter of fitting portion (fitting portion body) and diameter of opening of electroconductive substrate (mm) | Content of glass fibers (% by mass) | Arithmetic average roughness Ra of fitting portion (fitting portion body) |
|---|---|---|---|---|---|
| Flange 1 | 84 | 80.490 | −0.01 | 30 | 0.75 |
| Flange 2 | 84 | 80.505 | 0.005 | 30 | 0.53 |
| Flange 3 | 84 | 80.501 | 0.01 | 30 | 0.62 |
| Flange 4 | 84 | 80.550 | 0.05 | 19 | 0.62 |
| Flange 5 | 84 | 80.550 | 0.05 | 20 | 0.66 |
| Flange 6 | 84 | 80.550 | 0.05 | 30 | 0.49 |
| Flange 7 | 84 | 80.550 | 0.05 | 30 | 0.50 |
| Flange 8 | 84 | 80.550 | 0.05 | 30 | 0.61 |
| Flange 9 | 84 | 80.550 | 0.05 | 30 | 0.80 |
| Flange 10 | 84 | 80.550 | 0.05 | 30 | 0.81 |
| Flange 11 | 84 | 80.550 | 0.05 | 40 | 0.66 |
| Flange 12 | 84 | 80.550 | 0.05 | 41 | 0.66 |
| Flange 13 | 84 | 80.600 | 0.1 | 30 | 0.65 |
| Flange 14 | 84 | 80.610 | 0.11 | 30 | 0.63 |
| Flange 15 | 84 | 80.630 | 0.13 | 30 | 0.69 |

TABLE 2

| | Electrophotographic photoreceptor | | | | | |
|---|---|---|---|---|---|---|
| | Type | Abrasion amount of outermost layer (nm per 1,000 rotation of photoreceptor) | Type of flange | Total runout of electrophotographic photoreceptor (μm) | Evaluation of initial unevenness in image density | Evaluation of long-term unevenness in image density |
| Example 1 | (2) | 3 | (3) | 10.0 | A | A |
| Example 2 | (2) | 3 | (4) | 20 | A | A |
| Example 3 | (2) | 3 | (5) | 10 | A | A |
| Example 4 | (2) | 3 | (6) | 22 | A | A |
| Example 5 | (2) | 2 | (7) | 7 | AA | AA |
| Example 6 | (2) | 3 | (8) | 8 | AA | AA |

TABLE 2-continued

| | Electrophotographic photoreceptor | | | | | |
|---|---|---|---|---|---|---|
| | Type | Abrasion amount of outermost layer (nm per 1,000 rotation of photoreceptor) | Type of flange | Total runout of electrophotographic photoreceptor (μm) | Evaluation of initial unevenness in image density | Evaluation of long-term unevenness in image density |
| Example 7 | (2) | 4 | (9) | 6 | AA | AA |
| Example 8 | (2) | 3 | (10) | 19 | A | A |
| Example 9 | (2) | 5 | (11) | 11 | A | A |
| Example 10 | (2) | 3 | (12) | 21 | A | A |
| Example 12 | (2) | 3 | (13) | 10 | A | A |
| Example 13 | (1) | 16 | (8) | 12 | A | B |
| Comparative Example 1 | (2) | 3 | (1) | 46 | C | C |
| Comparative Example 2 | (2) | 3 | (2) | 39 | B | B |
| Comparative Example 3 | (2) | 4 | (14) | 37 | B | B |
| Comparative Example 4 | (2) | 3 | (15) | 52 | C | C |

It is understood from the results that as compared to Comparative Examples, the total runout of the electrophotographic photoreceptor is suppressed, and good results are obtained in evaluation of initial and long-term unevenness in image density in Examples.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The exemplary embodiments were chosen and described in order to best exemplify the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. An electrophotographic photoreceptor comprising:

an electrophotographic photoreceptor body containing a cylindrical electroconductive substrate having openings at both ends in an axial direction, the cylindrical electroconductive substrate having a thickness of approximately 2 mm or more at a center portion in an axial direction and having a socket joint portion on each of inner surfaces of both end portions in an axial direction; and a photosensitive layer provided on an outer surface of the electroconductive substrate; and a support member fit in each of the openings of the electroconductive substrate, the support member containing glass fibers that have a diameter of from 6 μm to 15 μm and having a fitting portion which has an outer diameter that is larger than a diameter of the opening by a range of from approximately 0.01 mm to approximately 0.1 mm, the fitting portion being press-fit into the opening.

2. The electrophotographic photoreceptor according to claim 1, wherein the support member contains a resin and the glass fibers in a content of from approximately 20% to approximately 40% by mass with respect to the resin, and a surface of the fitting portion of the support member that is in contact with the inner surfaces of the end portions of the cylindrical electroconductive substrate in the axial direction has an arithmetic average roughness Ra of from approximately 0.5 μm to approximately 0.8 μm.

3. The electrophotographic photoreceptor according to claim 2, wherein an abrasion amount of an outermost layer of the electrophotographic photoreceptor body is approximately 15 nm or less per 1,000 rotations.

4. An image forming apparatus comprising:

the electrophotographic photoreceptor according to claim 2;

a charging unit that charges the electrophotographic photoreceptor;

an electrostatic latent image forming unit that forms an electrostatic latent image on the charged electrophotographic photoreceptor;

a developing unit that contains a developer containing a toner and develops the electrostatic latent image, which is formed on the electrophotographic photoreceptor, with the developer, thereby forming a toner image; and a transfer unit that transfers the toner image to a transfer medium.

5. The electrophotographic photoreceptor according to claim 1, wherein an abrasion amount of an outermost layer of the electrophotographic photoreceptor body is approximately 15 nm or less per 1,000 rotations.

6. An image forming apparatus comprising:

the electrophotographic photoreceptor according to claim 5;

a charging unit that charges the electrophotographic photoreceptor;

an electrostatic latent image forming unit that forms an electrostatic latent image on the charged electrophotographic photoreceptor;

a developing unit that contains a developer containing a toner and develops the electrostatic latent image, which is formed on the electrophotographic photoreceptor, with the developer, thereby forming a toner image; and a transfer unit that transfers the toner image to a transfer medium.

7. The electrophotographic photoreceptor according to claim 1, wherein the thickness at the center portion in the axial direction is from approximately 2 mm to approximately 5 mm.

8. The electrophotographic photoreceptor according to claim 1, wherein the thickness at the center portion in the axial direction is from approximately 2 mm to approximately 3 mm.

9. The electrophotographic photoreceptor according to claim 1, wherein a difference between the thickness Tc at the center portion in the axial direction and a thickness Te at the socket joint portion is from approximately 0.1 mm to approximately 1.0 mM.

10. The electrophotographic photoreceptor according to claim 1, wherein the outer diameter of the fitting portion of the support member is larger than the diameter of the opening of the cylindrical electroconductive substrate by a range of from approximately 0.01 mm to approximately 0.08 mm.

11. The electrophotographic photoreceptor according to claim 1, wherein the electrophotographic photoreceptor further contains a surface protective layer.

12. A process cartridge for image forming apparatus comprising the process cartridge, being attachable to and detachable from an image forming apparatus, and containing the electrophotographic photoreceptor according to claim 1.

13. An image forming apparatus comprising:

the electrophotographic photoreceptor according to claim 1;

a charging unit that charges the electrophotographic photoreceptor;

an electrostatic latent image forming unit that forms an electrostatic latent image on the charged electrophotographic photoreceptor;

a developing unit that contains a developer containing a toner and develops the electrostatic latent image, which is formed on the electrophotographic photoreceptor, with the developer, thereby forming a toner image; and a transfer unit that transfers the toner image to a transfer medium.

14. The electrophotographic photoreceptor according to claim 1, wherein a total runout of the electrophotographic photoreceptor is from 6 μm to 22 μm.

15. The electrophotographic photoreceptor according to claim 1, wherein a total runout of the electrophotographic photoreceptor is from 6 μm to 8 μm.

* * * * *